US010913100B2

(12) United States Patent
Beltran et al.

(10) Patent No.: US 10,913,100 B2
(45) Date of Patent: Feb. 9, 2021

(54) SYSTEM AND METHOD FOR INCREMENTAL FORMING

(71) Applicants: Northwestern University, Evanston, IL (US); The Penn State Research Foundation, University Park, PA (US)

(72) Inventors: Michael Beltran, Chicago, IL (US); Jian Cao, Wilmette, IL (US); John T. Roth, Erie, PA (US)

(73) Assignee: Northwestern University, Evanston, IL (US)

( * ) Notice: Subject to any disclaimer, the term of this patent is extended or adjusted under 35 U.S.C. 154(b) by 841 days.

(21) Appl. No.: 14/954,098

(22) Filed: Nov. 30, 2015

(65) Prior Publication Data

US 2016/0082498 A1 Mar. 24, 2016

Related U.S. Application Data

(63) Continuation of application No. 13/667,846, filed on Nov. 2, 2012, now Pat. No. 9,221,091.
(Continued)

(51) Int. Cl.
*B21D 31/00* (2006.01)
*B21D 37/16* (2006.01)

(52) U.S. Cl.
CPC ..... *B21D 31/005* (2013.01); *B21D 37/16* (2013.01)

(58) Field of Classification Search
CPC .... B21D 31/005; B21D 37/16; C21D 9/0018; C21D 9/46; C21D 9/48; C21D 1/04;
(Continued)

(56) References Cited

U.S. PATENT DOCUMENTS 4,273,738 A 6/1981 Spengler
4,532,793 A 8/1985 Bezold
(Continued)

FOREIGN PATENT DOCUMENTS

WO WO 2007082972 A1 7/2007
WO WO 2012030835 A2 3/2012

OTHER PUBLICATIONS

International Preliminary Report on Patentability and Written Opinion for PCT/US2011/034360 dated Nov. 13, 2012.
(Continued)

*Primary Examiner* — Gregory D Swiatocha
(74) *Attorney, Agent, or Firm* — Banner & Witcoff, Ltd.

(57) ABSTRACT

A system includes a frame configured to hold a workpiece and first and second tool positioning assemblies configured to be opposed to each other on opposite sides of the workpiece. The first and second tool positioning assemblies each include a toolholder configured to secure a tool to the tool positioning assembly, a first axis assembly, a second axis assembly, and a third axis assembly. The first, second, and third axis assemblies are each configured to articulate the toolholder along a respective axis. Each axis assembly includes first and second guides extending generally parallel to the corresponding axis and disposed on opposing sides of the toolholder with respect to the corresponding axis. Each axis assembly includes first and second carriages articulable along the first and second guides of the axis assembly, respectively, in the direction of the corresponding axis.

18 Claims, 11 Drawing Sheets

Related U.S. Application Data

(60) Provisional application No. 61/642,598, filed on May 4, 2012, provisional application No. 61/612,034, filed on Mar. 16, 2012, provisional application No. 61/555,951, filed on Nov. 4, 2011.

(58) Field of Classification Search
CPC ..... C21D 1/40; C21D 1/42; H05B 3/0004; H05B 3/023; H05B 6/101
See application file for complete search history.

(56) References Cited

U.S. PATENT DOCUMENTS

| | | | | |
|---|---|---|---|---|
| 6,798,088 | B2 * | 9/2004 | Hsu | B23Q 1/012 310/12.13 |
| 6,826,172 | B1 | 11/2004 | Auguart | |
| 7,172,375 | B2 * | 2/2007 | Tanoue | B23Q 1/012 409/202 |
| 7,302,821 | B1 * | 12/2007 | Dariavach | B21D 5/04 219/152 |
| 7,357,769 | B2 | 4/2008 | Takayama et al. | |
| 7,416,473 | B2 | 8/2008 | Belli et al. | |
| 7,516,640 | B2 * | 4/2009 | Golovashchenko | B21D 26/06 72/342.94 |
| 8,021,501 | B2 | 9/2011 | Roth | |
| 8,302,442 | B2 | 11/2012 | Kiridena et al. | |
| 8,322,176 | B2 | 12/2012 | Johnson et al. | |
| 8,741,079 | B2 | 6/2014 | Roth et al. | |
| 2002/0169857 | A1 | 11/2002 | Martija et al. | |
| 2003/0046022 | A1 | 3/2003 | Silverman | |
| 2003/0056561 | A1 * | 3/2003 | Butscher | A61C 7/04 72/295 |
| 2004/0036389 | A1 | 2/2004 | Tsai | |
| 2007/0101786 | A1 * | 5/2007 | Yang | B21D 26/033 72/61 |
| 2009/0007622 | A1 | 1/2009 | Segura Golorons et al. | |
| 2009/0044590 | A1 | 2/2009 | Roth | |
| 2009/0158805 | A1 | 6/2009 | Callebaut et al. | |
| 2010/0107720 | A1 | 5/2010 | Polen et al. | |
| 2010/0199742 | A1 * | 8/2010 | Johnson | B21D 22/02 72/386 |
| 2012/0024034 | A1 | 2/2012 | Ren et al. | |

OTHER PUBLICATIONS

International Search Report and Written Opinion for PCT/US12/60616 dated Apr. 5, 2013.

International Preliminary Report on Patentability from PCT/US2012/060616 dated Apr. 29, 2014.

Incremental Forming of Sheet Metal (27097), J. Cao, V. Reddy and Y. Wang, http://ttp.northwestern.edu/abstracts/viewabs.php?id=344&cat=157.

Chinese Journal of Mechanical Engineering, vol. 43, No. 12, Dec. 2007, Incremental Forming Methods on Complicated Sheet Parts with English Translation of Abstract.

Allwood, J.M., Braun, D., Music, 0., The effect of partially cut-out blanks on geometric accuracy in incremental sheet forming, Journal of Materials Processing Technology, Journal of Materials Processing Technology 210 (2010), pp. 1501-1510.

Allwood, J.M., Music, 0., Raithathna, A., Duncan, S., Closed-loop feedback control of product properties in flexible metal forming processes with mobile tools, CIRP Annal—Manufacturing Technology 58 (2009), pp. 287-290.

Formisano, A., Durante, M., Langella, A., Minutolo, F. Capece, Manufacture of a component with concave-convex shape by backdrawing incremental forming process, Department of Materials and Production Engineering (5 pgs).

Jeswiet, J., Micari, F., Hirt, G., Brameley, A., Duflou, J., Allwood, J., Asymmetric Single Point Incremental Forming of Sheet Metal, CIRP Annals—Manufacturing Technology, (2005) vol. 54(2), pp. 88-114.

Li, M, Zhang, L., Mo, Jr., Liu, G., Tool-path generation method for sheet metal incremental forming process, Materials Research Innovations, vol. 15, Suppl. 1, (2011) , pp. s278-s282.

M. Skjoedt, M.H. Hancock, N. Bay, Creating Helical Tool Paths for Single Point Incremental Forming, Key Engineering Materials v. 344 (2007), pp. 583-590.

Malhotra, R., Cao, J., Beltran, M., Xu, D., Magargee, J., Kiridena, V., Xia, Z. C., Accumulative-DSIF Strategy for Enhancing Process Capabilities in Incremental Forming, CIRP Annals—Manufacturing Technology, vol. 61 (2012), pp. 251-254.

Malhotra, R., Cao, J., Ren, F., Kiridena, V., Xia, C., Reddy, N., Improvement of Geometric Accuracy in Incremental Forming by Using a Squeezing Toolpath Strategy With Two Forming Tools, Journal of Manufacturing Science and Engineering, (Dec. 2011), vol. 133, pp. 061019/1-061019/10.

Malhotra, R., Reddy, N.V., Cao, J., Automatic 3D Spiral Toolpath Generation for Single Point Incremental Forming, Journal of Manufacturing Science and Engineering, (Dec. 2010), vol. 132, pp. 061003/1-061003/10.

Meier, H., Magnus, C., Smukala, V., Impact of superimposed pressure on dieless incremental sheet metal forming with two moving tools, CIRP Annals—Manufacturing Technology 60 (2011) pp. 327-330.

Meier, H., Smukala, V., Dewald, 0., Zhang, J., Two Point Incremental Forming with Two Moving Forming Tools, Key Engineering Materials, vol. 344 (2007), pp. 599-605.

Paniti, Imre, CAD API Based Tool Path Control for Novel Incremental Sheet Forming, Pollack Periodica, vol. 5, No. 2 (2010) pp. 81-90.

Tekkaya, A. Erman, Shankar, Ravi , Sebastiani, Gerd, Hornberg, Werner and Kleiner, Matthias, Surface reconstruction for incremental forming, Springer, (2007) Prod. Eng. Res. Devel. 1, pp. 71-78.

* cited by examiner

SYSTEM AND METHOD FOR INCREMENTAL FORMING

CROSS-REFERENCE TO RELATED APPLICATIONS

This application claims priority to U.S. Provisional Application No. 61/555,951, which was filed on 4 Nov. 2011, and is entitled "System And Method For Incremental Forming" (the "'951 application"); U.S. Provisional Application No. 61/612,034, which was filed on 16 Mar. 2012, and is entitled "System And Method For Accumulative Double-sided Incremental Forming" (the "'034 application"); and U.S. Provisional Application No. 61/642,598, which was filed on 4 May 2012, and is entitled "System And Method For Accumulative Double-sided Incremental Forming" (the "'598 application").

This application also is related to U.S. Nonprovisional application Ser. No. 13/654,071, which was filed on 17 Oct. 2012, and is entitled "System And Method For Accumulative Double-sided Incremental Forming" (referred to herein as the "'071 application") and U.S. Provisional Application Ser. No. 61/550,666, which was filed on 24 Oct. 2011, and is entitled "System And Method For Incremental Forming" (referred to herein as the "'666 application").

The entire disclosures of the '951 application, the '034 application, the '598 application, the '071 application, and the '666 application are incorporated by reference herein.

STATEMENT REGARDING FEDERALLY SPONSORED RESEARCH OR DEVELOPMENT

This invention was made with government support under DE-EE00033460 awarded by the Department of Energy and CMMI0727843 awarded by the National Science Foundation. The government has certain rights in the invention.

BACKGROUND

Currently, low volume production of sheet metal components is a relatively high cost, inflexible process, requiring costly sets of dies, typically made of cast steel. These dies, while well suited to mass production, are poorly matched to relatively low volume production and prototyping needs. Die sets can cost over $1 million per set, can be difficult to move, and/or costly to modify if the final required geometry of parts is not met.

Some implementations of incremental forming utilize single point incremental forming, which allows for the formation of basic sheet metal components without a die. Single point incremental forming is a process by which a hemispherical tool is moved along a preprogrammed path into a peripherally clamped metal sheet, to impart a desired shape. This process allows for the creation of a shape in one direction, without the need for a shape-specific die.

However, complications still exist in the form of unwanted sheet bending and deformation. This has been partially addressed with partial and full dies implemented on the opposing side of the forming tool to create a support structure; however, use of such partial or full dies re-introduces the high costs and low flexibility of a die.

BRIEF SUMMARY

FIGS. 1A, 1B, 10 and 1D illustrate various implementations of incremental forming. For example, FIG. 1A depicts single point incremental forming as discussed above. Also, FIGS. 1B and C depict the implementation of partial and full dies in incremental forming, also discussed above. FIG. 1D depicts double-sided incremental forming.

Double-sided incremental forming (see FIG. 1B) is a more flexible, lower cost method of sheet metal forming which seeks to introduce rapid and simple low volume sheet metal production. In one embodiment, a system (e.g., the system 300 shown in FIG. 2) capable of executing this manufacturing process is provided. In some embodiments, a system may be capable of accurately positioning metal forming tools over an area of about 10 inches by about 10 inches within about 0.002 inches, under forming loads required for sheet metal aluminum, magnesium, steel, alloys, and the like. The system may be controlled using one or more methods, processes, techniques, software systems, and the like, such as those set forth in the '666 application, '951 application, '034 application, and '598 application.

Some embodiments include the capability to introduce a current, for example a relatively high current, through two forming tools disposed on opposite sides of a workpiece (e.g., a sheet of metal), which reduces the required forming force of a metal, while simultaneously or concurrently allowing a metal to be stretched further than under normal conditions. In some embodiments, current may be introduced via sheet material surrounding or proximate to one or more tool contact points by attaching a current-introducing apparatus to the material proximate to a forming tool. Some embodiments also may include the capability to monitor temperature of the metal through, for example, a thermal infrared camera (e.g., camera 308 depicted schematically in FIG. 2). Some embodiments may also include the capability to detect forming forces (e.g., to help prevent overload of the machine), and/or detect fracture failure of the material. Some embodiments may also include the capability to real-time monitor the sheet position and geometry. For example, the camera 308 may be alternatively or additionally configured to optically measure or detect a displacement and/or a geometry of a workpiece and/or one or more tools. As another example, a detection unit configured to measure the displacement of one or more tools may be employed.

Double-sided incremental forming utilizes two opposing tools to deform and support a workpiece such as a sheet of metal, generally resulting in sheet deformation only where desired (see FIG. 1B). Thus, costly dies may be removed, and the benefits of using only non-specific tools can be fully realized. For example, a tool having a generally hemispheric head may be used in a variety of applications to produce a wide variety of shapes or features, in contrast to particular dies limited to specific applications. Various embodiments of systems and methods described herein may be capable of executing double-sided incremental forming in a highly accurate manner, while remaining low cost and flexible, and also introducing new improvements to the forming process.

Currently, few other prototype machines capable of double-sided incremental forming (DSIF) are known to Applicants to exist. The design of such machines generally heavily relied on components retrofitted to meet the demands of a DSIF machine. At least one embodiment of the system disclosed herein is particularly suited to the demands of double-sided incremental forming, while surpassing the capabilities of these existing machines, and remaining relatively low cost.

In one embodiment, a system includes a frame configured to hold a workpiece and first and second tool positioning assemblies coupled with the frame. The first and second tool positioning assemblies are configured to be opposed to each other on opposite sides of the workpiece. Each of the first and second tool positioning assemblies includes a toolholder, a first axis assembly, a second axis assembly, and a third axis assembly. The toolholder is configured to secure a tool to the tool positioning assembly. The first axis assembly is configured to articulate the toolholder along a first axis. The first axis assembly includes first and second guides extending generally parallel to the first axis and disposed on opposing sides of the toolholder with respect to the first axis. The first axis assembly includes first and second carriages articulable along the first and second guides of the first axis assembly, respectively, in the direction of the first axis. The second axis assembly is configured to articulate the toolholder along a second axis that is substantially perpendicular to the first axis. The second axis assembly includes first and second guides extending generally parallel to the second axis and disposed on opposing sides of the toolholder with respect to the second axis. The second axis assembly includes first and second carriages articulable along the first and second guides of the second axis assembly, respectively, in the direction of the second axis. The third axis assembly is configured to articulate the toolholder along a third axis that is substantially perpendicular to the first axis and substantially perpendicular to the second axis. The third axis assembly includes first and second guides extending generally parallel to the third axis and disposed on opposing sides of the toolholder with respect to the third axis. The third axis assembly includes first and second carriages articulable along the first and second guides of the third axis assembly, respectively, in the direction of the third axis.

In another embodiment, a system is provided including a frame configured to hold a workpiece, first and second tool positioning assemblies coupled with the frame, and a current source configured to deliver a current. The first and second tool positioning assemblies are configured to be opposed to each other on opposite sides of the workpiece. The first tool positioning assembly includes a first toolholder configured to secure a first tool, and the second tool positioning assembly includes a second toolholder configured to secure a second tool. The first and second toolholders are configured to receive the current from the current source and to pass the current between the first and second toolholders and through the workpiece when the first tool and the second tool engage the workpiece.

In yet another embodiment, a method for forming a workpiece is provided. The method includes securing the workpiece in a frame. The method also includes drawing opposing first and second tools toward each other, with the first tool engaging a first side of the workpiece, and the second tool engaging a second, opposite side of the workpiece. The method further includes passing a current between the first and second tools, wherein the current passes through the workpiece. Also, the method includes articulating at least one of the first and second tools while the first and second tools engage the workpiece and the current passes through the workpiece.

One or more technical effects of at least one embodiment include reduced costs for forming operations (e.g., low production forming), improved forming at reduced forming forces, improved control of forming operations, reduced reliance upon application specific tooling, increased utility of non-specific tooling across a variety of forming applications, improved mobility of forming equipment, and/or improved user friendliness of forming equipment or processes.

DESCRIPTION OF THE DRAWINGS

The figures of the application illustrate one or more embodiments of the inventive subject matter. The dimensions, scales, and/or relative sizes of the components shown in the attached figures are meant to be examples of dimensions, scales, and/or relative sizes, but are not intended to be limiting on all embodiments of the subject matter described herein.

FIGS. 10A, 10B and 100 illustrate one embodiment of a toolholder frame that may be included in the axis assembly shown in FIG. 3.

DETAILED DESCRIPTION

Figure 1A:
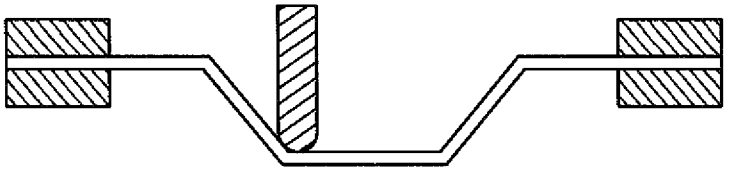
FIGS. 1A, 1B, 1C and 1D are schematic illustrations of some implementations of incremental forming.
Figure 1B:
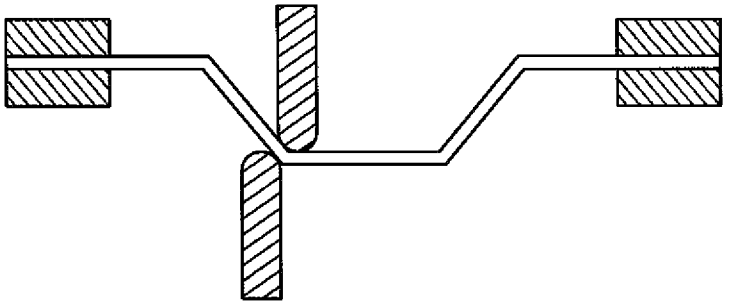
Figure 1C:
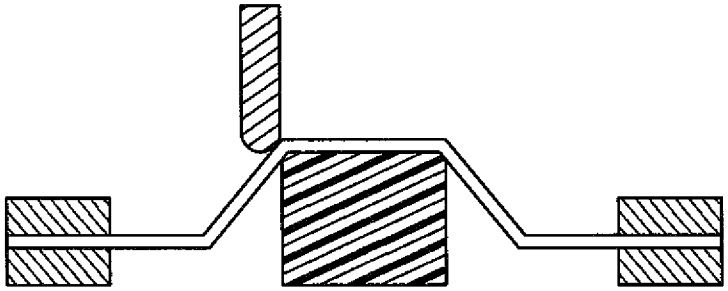
Figure 1D:
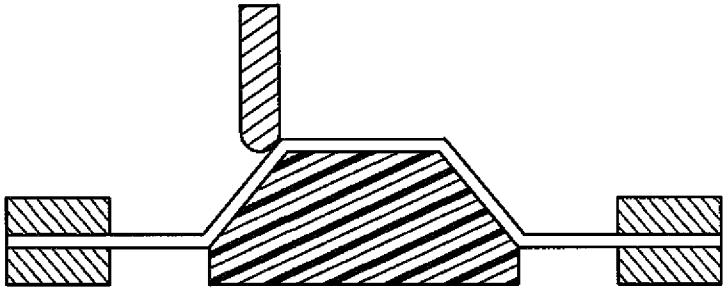
Figure 2:
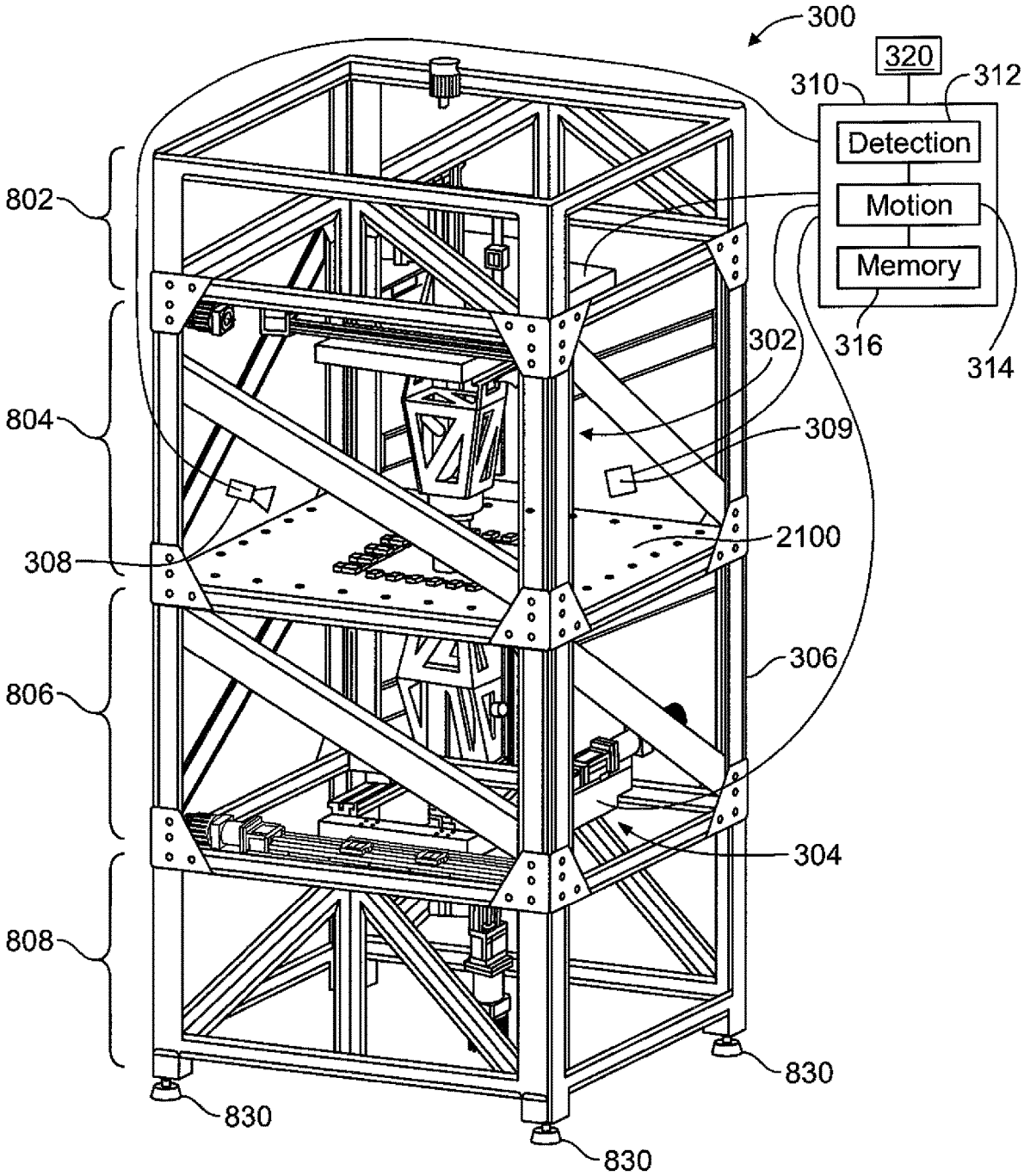
FIG. 2 is a perspective view of one embodiment of an incremental forming system.
Figure 3:
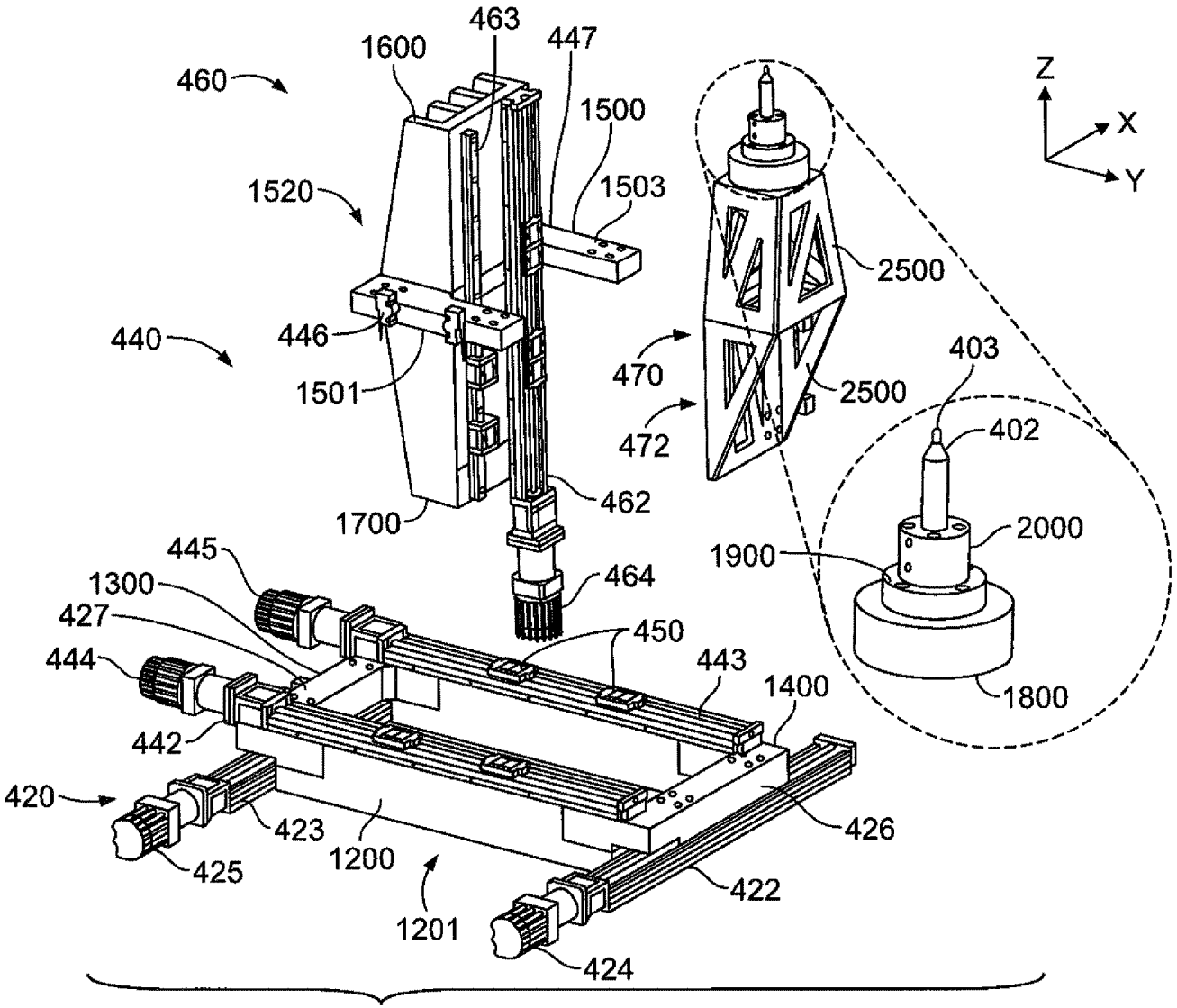
FIG. 3 is an exploded perspective view of one embodiment of a gantry-style axis assembly in the system shown in FIG. 2.
Figure 4:
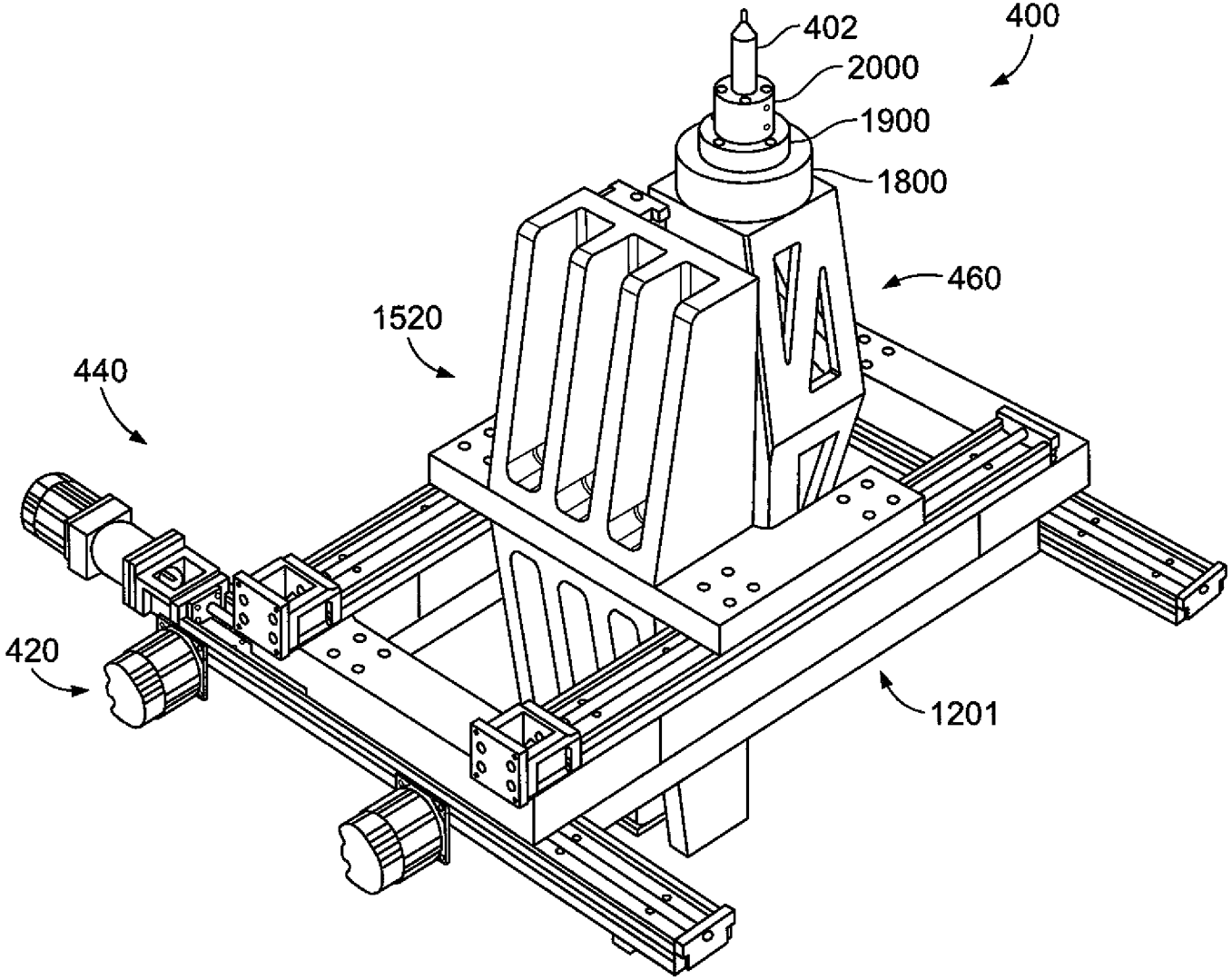
FIG. 4 is a perspective view of the axis assembly shown in FIG. 3 in an assembled configuration.

FIG. 2 is a perspective view of one embodiment of an incremental forming system 300. FIG. 3 is an exploded perspective view of one embodiment of a gantry-style axis assembly 400 of the system 300 in accordance with one embodiment. FIG. 4 is a perspective view of the axis assembly 400 shown in FIG. 3. As seen in FIG. 2, the system 300 can include a top axis assembly 302 that includes an axis assembly 400 and a bottom axis assembly 304 that includes another axis assembly 400.

In the embodiment depicted in FIG. 2, the system 300 includes a top tool positioning assembly 302, a bottom tool positioning assembly 304, a frame 306, a thermal imaging camera 308, a heat treatment module 309, and a control module 310, and a blankholder frame 2100. The top tool positioning assembly 302 and the bottom tool positioning assembly 304 are configured to secure forming tools on opposing sides of a workpiece held in the blankholder frame 2100, for example, during a double-sided incremental forming operation. It should be noted that the terms "top" and "bottom" are used herein by way of example for convenience and clarity of description throughout this disclosure, and that other orientations or arrangements may be employed in various embodiments.

Each of the tool positioning assemblies 302, 304 may be understood as axis assemblies that in turn include one or more individual axis assemblies or sub-assemblies. In the depicted embodiment, for example, each of the tool positioning assemblies 302, 304 includes an x-axis assembly, a y-axis assembly, and a z-axis assembly. (See FIGS. 3 and 4, and related discussion.) Each of the tool positioning assemblies 302, 304 is configured to secure, position, and articulate a tool during a forming process. In the illustrated embodiment, the top tool positioning assembly 302 and the bottom tool positioning assembly 304 are substantially similar in construction, with the top tool positioning assembly 302 mounted toward a top axis section 802 of the frame 306 and configured to hold a forming tool 402 (see FIG. 3) in a downward orientation (in the sense of FIG. 2), and with the bottom tool positioning assembly 304 mounted toward a bottom axis section 808 of the frame 306 and configured to hold a forming tool 402 in an upward orientation (in the sense of FIG. 2). The blankholder frame 2100 is configured to secure a workpiece (e.g., a sheet of blank metal) in place during one or more forming operations. The blankholder frame 2100 is secured to the frame 306 and interposed between the top tool positioning assembly 302 and the bottom tool positioning assembly 304. The thermal imaging camera 308 is configured to obtain thermal information (e.g., information corresponding to a distribution or range of temperatures) regarding one or more tools and/or the workpiece during a forming process, and to provide the thermal information to the control module 310. The control module 310 is operably coupled to the top tool positioning assembly 302 and the bottom tool positioning assembly 304, and is configured to control the positioning and articulation of the tool positioning assemblies 302, 304.

Figure 8:
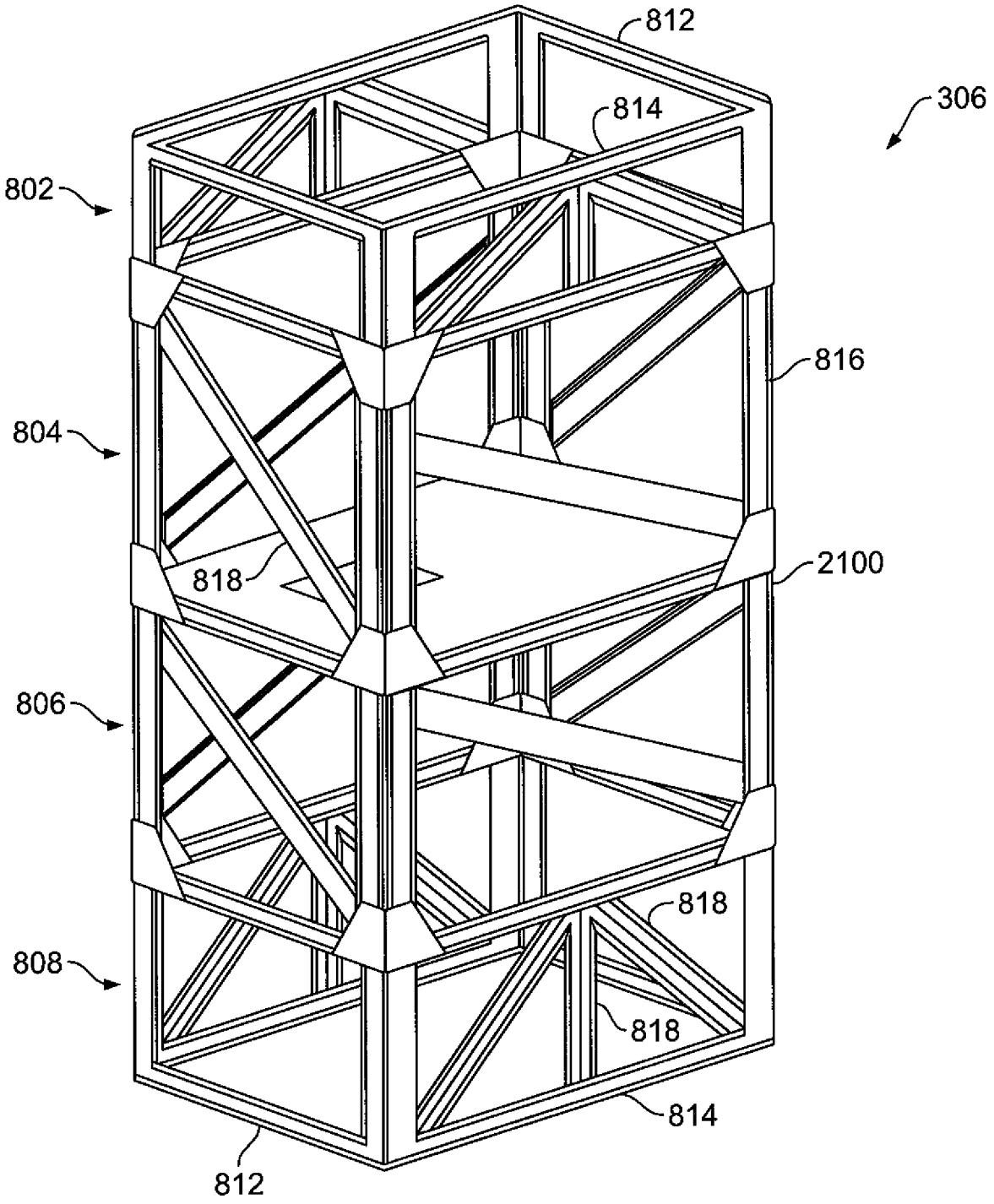
FIG. 8 is a perspective view of the frame shown in FIG. 1 in accordance with one embodiment.
Figure 9A:
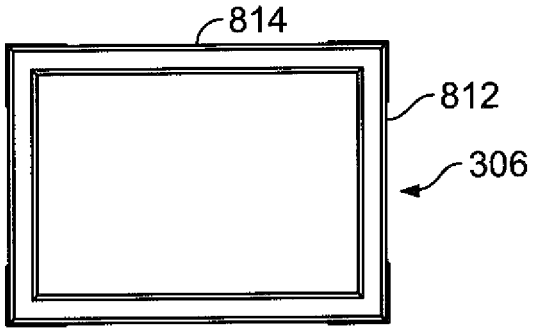
FIGS. 9A, 9B and 9C provide additional views of the frame shown in FIG. 2.
Figure 9B:
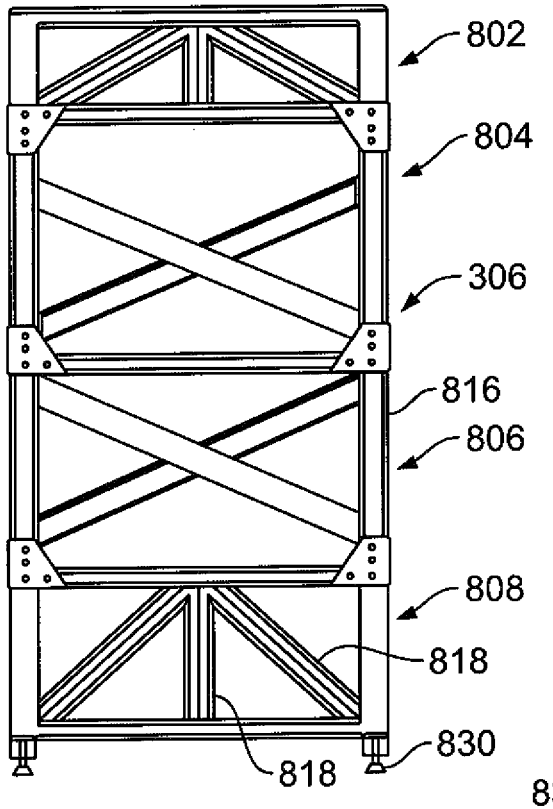
Figure 9C:
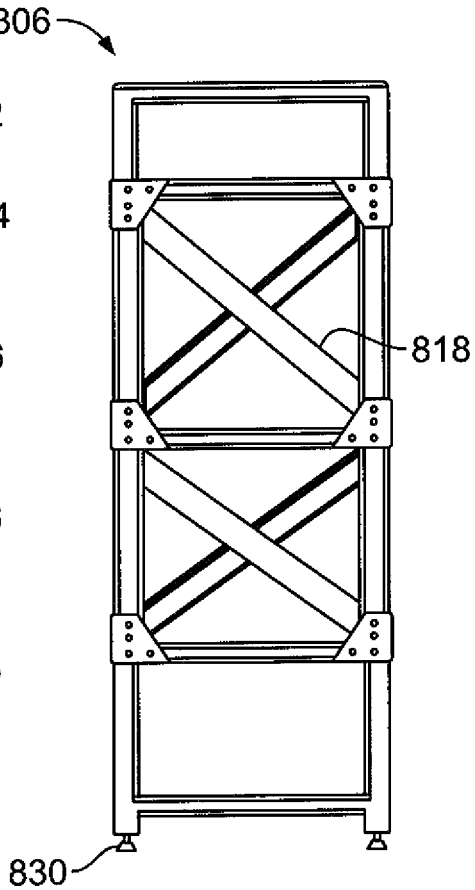

The frame 306 is configured to secure components of the system 300 in place for stable performance during a forming operation. A perspective view of the frame 306 is shown in FIG. 8. A top view and side views of the frame 306 are shown in FIGS. 9A, 9B and 9C, respectively.

The frame 306 includes a top axis section 802, a top blankholder section 804, a bottom blankholder section 806, and a bottom axis section 808. The top axis section 802 is configured to secure and house the top tool positioning assembly 302, and the bottom axis section 808 is configured to secure and house the bottom tool positioning assembly 304. The top blankholder section 804 and the bottom blankholder section 806 are disposed between the top and bottom axis sections 802, 808, and are configured to secure the blankholder frame 2100 in place between the top blankholder section 804 and the bottom blankholder section 808. The frame 306, for example, may have a width of about 39 inches, a depth of about 28.5 inches, and a height of about 78 inches. Other sizes and configurations may be utilized in various embodiments. For example, the embodiment depicted in FIG. 3 defines an interior space that is generally rectangular (with one side of the rectangle longer than the other) in cross-section. However, other shapes, such as a square cross-section, may be employed in other embodiments.

In the illustrated embodiment, the frame 306 is fabricated from generally low cost steel beam extrusions. In some embodiments, only basic welding may be required to assemble the various sections of the frame 306. For example, as best seen in FIGS. 8 and 9A, 9B and 9C, the frame 306 includes vertical members 816 joined to horizontal members 812, 814. Further, braces 818 of various sizes and orientations may be employed. The frame 306 also includes feet 830 (see FIGS. 2 and 9B and 9C). The feet 830 are configured to provide stability and/or facilitate level mounting of the frame 306, for example, to a floor. In some embodiments, the feet 830 may be adjustable, via, for example, a threaded member extending into a threaded sleeve of a vertical member 816. In the illustrated embodiment, the various members of the frame may be formed of extrusions having wall thicknesses of about ¼ inch. The braces 818 and horizontal members 812, 814 may be formed of 3 inch×2 inch Lshaped extrusions. The vertical members 816 may include segments of 3 inch×2 inch L-shaped extrusions in the top axis section 802 and bottom axis section 808, while including 3 inch×3 inch square extrusions in the top and bottom blankholder sections 804, 806. The various sizes and dimensions described herein are discussed by way of example and not limitation. Other shapes, sizes, or configurations of extrusions or other materials may be employed in alternate embodiments.

In one embodiment, the system 300 includes a gantry-style axis assembly 400 for several or all degrees of movement, neutralizing torque about each linear drive and guide, and allowing for smaller components to be used while maintaining stiffness and rigidity. Such an axis assembly 400 may be used for both the top tool positioning assembly 302 and the bottom tool positioning assembly 304. A first axis assembly 400 may be oriented with a secured tool 402 positioned downward in the sense of FIG. 2 to provide the top tool positioning assembly 302, and a second axis assembly 400 may be oriented with a secured tool 402 positioned upward in the sense of FIG. 2 to provide the bottom tool positioning assembly 304.

FIG. 3 illustrates an exploded perspective view of the gantry-style axis assembly 400 formed in accordance with an embodiment, and FIG. 4 illustrates the axis assembly 400 in an assembled configuration. The axis assembly 400 includes a first axis assembly (e.g., x-axis assembly 420), a second axis assembly (e.g., y-axis assembly 440), and a third axis assembly (e.g., z-axis assembly 460). Each of the x-axis assembly 420, y-axis assembly 440, and z-axis assembly 460 extend along a respective axis and are configured to articulate the toolholder 2000 of the axis assembly 400 along the respective axis. Each gantry-style axis assembly 420, 440, 460 includes a set of generally parallel guides on which a carriage is supported, with the toolholder 2000 disposed between carriages of given axis assembly along the given axis to neutralize or address torque resulting from a forming force. In the illustrated embodiment, the x-axis assembly 420 supports the y-axis assembly 440, the y-axis assembly 440 supports the z-axis assembly 460, and the z-axis assembly supports the toolholder 2000. Thus, the x-axis assembly 420 articulates the toolholder 2000 along the x-axis by moving the y-axis assembly 440 (by which the z-axis assembly 460 is supported), the y-axis assembly 440 articulates the toolholder 2000 along the y-axis by moving the z-axis assembly 460 (by which the toolholder 2000 is supported), and the z-axis assembly 460 articulates the toolholder 2000 by moving a frame to which the toolholder 2000 is mounted. The particular orientation and configuration depicted is intended as an example, as other arrangements may be employed in various embodiments.

The x-axis assembly 420 includes first and second guides 422, 423, corresponding first and second drive assemblies 424, 425, and corresponding first and second carriages 426, 427. The first and second guides 422, 423 extend generally parallel to the x-axis and are configured to be disposed on opposite sides of the toolholder 2000 when the axis assembly 400 is in an assembled configuration. The guides 422, 423, for example, may be supported by the frame 306. The first carriage 426 is articulable along the first guide 422, and the second carriage 427 is articulable along the second guide 423. The first drive assembly 424 is configured to articulate the first carriage 426 along the first guide 422, and the second drive assembly 425 is configured to articulate the second carriage 427 along the second guide 423. For example, the drive assemblies 424, 425 may include linear drive assemblies that are operably connected to motors. In some embodiments, a linear drive assembly may threadedly engage a motor such that a rotation of the motor is translated to linear motion of a corresponding carriage. The depicted motors are one example of a drive assembly that may be used to articulate a toolholder. Other mechanisms, such as a rack-and-pinion, pneumatic cylinder, or the like, may be used in various embodiments. Each drive assembly may also include carriage mounts (not shown for the x-axis assembly 420) that accept corresponding portions of a carriage that is supported by the guide.

Generally similarly, the y-axis assembly 440 includes first and second guides 442, 443, corresponding first and second drive assemblies 444, 445, and corresponding first and second carriages 446, 447. The first and second guides 442, 443 extend generally parallel to the y-axis and are configured to be disposed on opposite sides of the toolholder 2000 when the axis assembly 400 is in an assembled configuration. The first carriage 446 is articulable along the first guide 442, and the second carriage 447 is articulable along the second guide 443. The first drive assembly 444 is configured to articulate the first carriage 446 along the first guide 442, and the second drive assembly 445 is configured to articulate the second carriage 447 along the second guide 443. Each drive assembly may also include carriage mounts 450 that accept corresponding portions of a carriage that is supported by the guide.

Also, generally similarly, the z-axis assembly 460 includes first and second guides 462, 463, a first drive assembly 464, and corresponding first and second carriages 470, 472. Only one drive assembly 464 is depicted in FIGS. 3 and 4 for the z-axis assembly 460. In other embodiments, a second drive assembly may be associated with the second guide 463. The first and second guides 462, 463 extend generally parallel to the z-axis and are configured to be disposed on opposite sides of the toolholder 2000 when the axis assembly 400 is in an assembled configuration. The first carriage 470 is articulable along the first guide 462, and the second carriage 472 is articulable along the second guide 463. The first drive assembly 464 is configured to articulate the first carriage 470 along the first guide 462. For example, the first drive assembly 464 may also include carriage mounts 450 that accept corresponding portions of a carriage. In the illustrated embodiment, the first carriage 470 and second carriage 472 of the z-axis assembly 460 form portions of a toolholder frame 2500. A tool 402 is secured in a toolholder device 2000, which in turn is secured to the toolholder frame 2500.

Thus, the first drive assembly 464 of the z-axis assembly 460 may articulate the tool 402 along the z-axis (e.g., into and out of engagement with a workpiece secured in the blankholder frame 2100). Further, because the z-axis assembly 460 is articulable in the x- and y-directions by the x-axis assembly 420 and the y-axis assembly 440, the tool 402 may thus be articulated in the x- and y-directions as well. For example, during a double-sided incremental forming operation, the tool 402 may be articulated along the z-axis into engagement with a workpiece (with a corresponding tool brought into engagement with an opposite side of the workpiece). Then, with the tool 402 urged into the workpiece a desired distance and/or at a desired level of force provided by the first drive assembly 464, the tool 402 may be articulated in the x- and/or y-directions by the drive assemblies of the x- and y-axis assemblies 420, 440.

As seen in FIG. 2, the blankholder frame 2100 (see also FIG. 19 and related discussion) is configured to secure a workpiece, such as a sheet of metal, while one or more forming operations (e.g., double-sided incremental forming operations) are performed on the workpiece. In some embodiments, the workpiece may be secured to the blankholder frame 2100 by clamps. The blankholder frame 2100 is configured to be mounted or secured to the frame 306 in a position interposed between the top tool positioning assembly 302 and the bottom tool positioning assembly 304 so that tools may engage opposing sides of the workpiece.

As seen in FIG. 3, the toolholder device 2000 is configured to accept and secure in place a tool 402. The tool 402 may include an engagement surface 403 configured to engage a workpiece. The engagement surface 403 may be substantially hemispherically shaped and configured to be used for forming a variety of shapes or features. In some embodiments, the engagement surface 403 may be formed in other shapes. For example, the engagement surface 403 may be conical. As another example, the engagement surface 403 may be a freeform surface. As discussed herein, a freeform surface may be understood as an asymmetrical surface, a surface having a shape that is not defined by a single mathematical relationship (e.g., equation or function between two or more geometric axes), an amorphous surface, or the like. In some embodiments, the toolholder device 2000 may be electrically conductive so that a current introduced into the toolholder device 2000 may pass to (and through) the tool 402. The current may be passed through the workpiece to reduce required forces to form the workpiece. In some embodiments, the tool 402 may be stationary with respect to the toolholder device 2000, while in other embodiments, the tool 402 may rotate with respect to the toolholder device 2000. For example, the tool 402 may be rotated at a pre-set speed. In some embodiments, the pre-set speed may be within a range of about 4000 revolutions per minute or less.

In the illustrated embodiment, the toolholder device 2000 is mounted to an insulator device 1900. The insulator device 1900 is configured to electrically insulate various components of the system 300 from a current introduced into the toolholder device 2000. The insulator device 1900, for example, may be made of a ceramic material.

The illustrated embodiment also includes a load cell 1800 to which the insulator device 1900 is mounted. The load cell 1800 may be configured to convert an imparted force to an electrical signal. The electrical signal may be communicated to the control module 310, with the control module 310 configured to analyze the signal to determine, for example, if the signal corresponds to an imparted force that may be a source of concern (e.g., a sudden unexpected reduction in force that may indicate a failure), and/or determine if a force used to urge a tool against the workpiece may be modified for improved forming.

As discussed above, each of the x-, y-, and z-axis assemblies position the toolholder between corresponding carriages and guides along the respective axis. This arrangement, for example, may allow for improved neutralization of torques induced during a forming operation while still allowing the use of relatively lightweight structural members and reducing overall size and/or weight of a forming device. In this context, neutralization of a torque may be understood as the effective and efficient addressing of a torque induced during a forming operation. By centering or positioning the tool (the point of application of an applied force during a forming operation) between carriage assemblies along the respective axis, cantilevering may be avoided, and each resulting torque may be addressed by at least one compressive reactive engagement between a carriage and a guide along a given axis (e.g., an urging of a carriage bearing surface against a guide bearing surface). In contrast, if the applied force were not disposed between carriage assemblies along a given axis, it would be possible for a tensile engagement (e.g., an urging of a carriage away from a guide) to bear the entire reactive force, and/or for an applied force to result in a cantilevering about a guide and carriage, which may result in increased bending and/or torsion.

Figure 5:
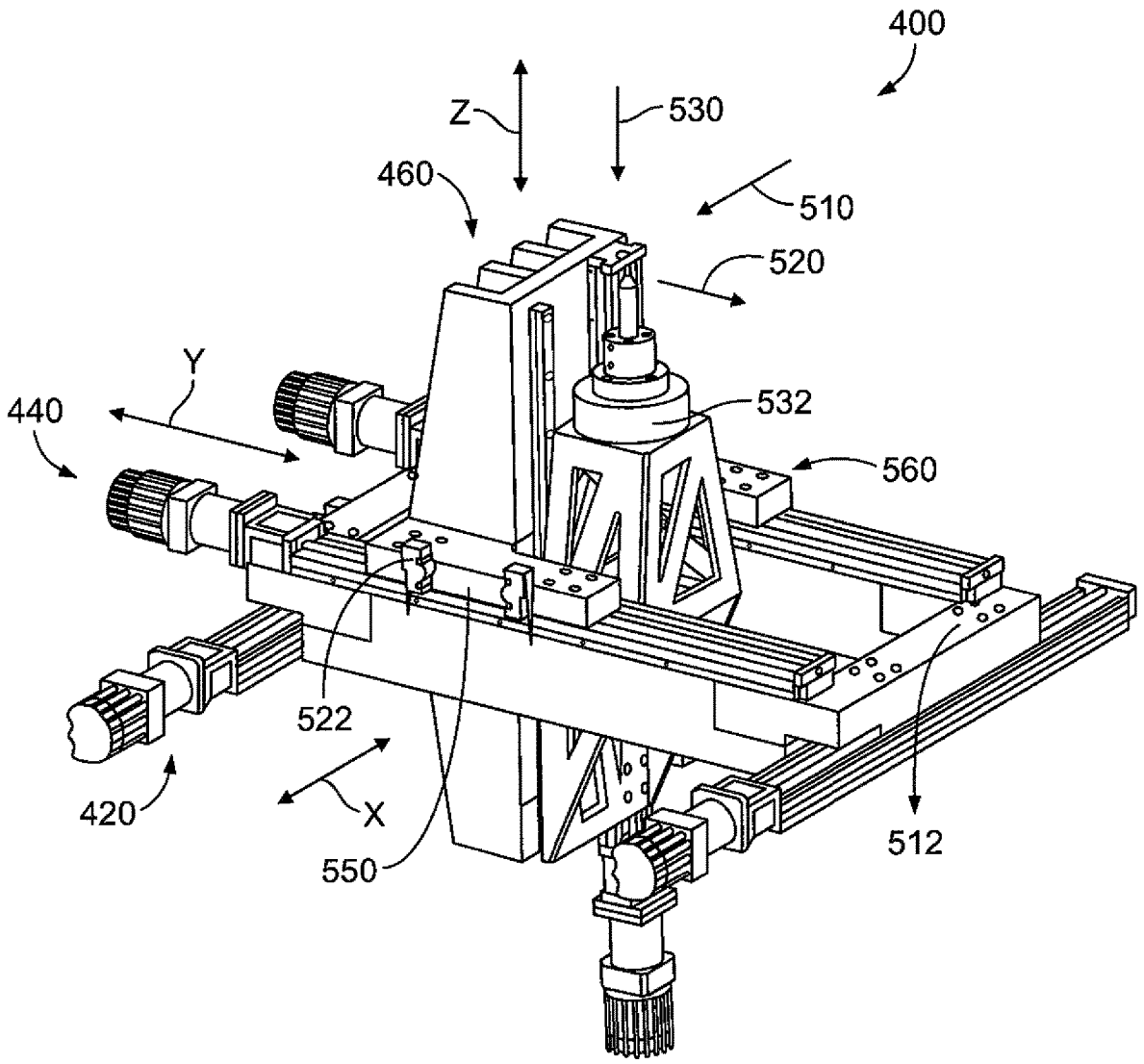
FIG. 5 is a perspective view of the gantry-style axis assembly shown in FIGS. 3 and 4 depicting forces and torques to which the assembly may be subjected.

FIG. 5 depicts forces and torques that may be imparted upon an axis assembly 400 due to engagement of a tool 402 with a workpiece. For example, a force 510 in the x-direction may result in a torque 512. The torque 512, for example, may be effectively and efficiently addressed by the engagement of the carriages of the x-axis assembly 420 along at least a portion of the length of the guides of the x-axis assembly 420. The torque 512 may also be effectively and efficiently addressed by the engagement of the carriages against the dual guides of the y-axis assembly 440 and the z-axis assembly 460. For example, the force 510 applied in the direction indicated in FIG. 5 will result in a compressive reaction between the carriage and guide at location 550 of the y-axis assembly 460, and a tensile reaction between the carriage and guide at location 560 of the y-axis assembly 460. If the direction of force 510 were reversed, there would result a compressive reaction between the carriage and guide at location 560 of the y-axis assembly 460, and a tensile reaction between the carriage and guide at location 550 of the y-axis assembly 460.

Similarly, a force 520 in the y-direction may result in a torque 522. The torque 522, for example, may be effectively and efficiently addressed by the engagement of the carriages of the y-axis assembly 440 along at least a portion of the length of the guides of the y-axis assembly 440. Further, the torque 522 may be effectively and efficiently addressed by the engagement of the carriages of the z-axis assembly 460 along at least a portion of the length of the guides of the z-axis assembly 460 (the imposed force may be generally centered between the guides of the z-axis assembly). The torque 522 may also be effectively and efficiently addressed by the engagement of the carriages in the dual guides of the x-axis assembly 420. (The positioning of the tool and resulting imparted force between the carriages of the x-axis assembly 420 helps insure that one of the engagements between a carriage and a guide of the x-axis assembly 420 will be a compressive engagement instead of a tensile engagement.)

Similarly, a force 530 in the z-direction may result in a torque 532. As the tool (and thus the force applied) is not aligned with the guides of the z-axis assembly 460, the torque 532 may act in a similar direction as the torque 522 discussed above, as shown in FIG. 5. The torque 532, for example, may be effectively and efficiently addressed by the engagement of the carriages of the y-axis assembly 440 along at least a portion of the length of the guides of the y-axis assembly 440. Further, the torque 532 may be effectively and efficiently addressed by the engagement of the carriages of the z-axis assembly 460 along at least a portion of the length of the guides of the z-axis assembly 460 (the imposed force may be generally centered between the guides of the z-axis assembly). The torque 532 may also be effectively and efficiently addressed by the engagement of the carriages in the dual guides of the x-axis assembly 420. (The positioning of the tool and resulting imparted force between the carriages of the x-axis assembly 420 helps insure that one of the engagements between a carriage and a guide of the x-axis assembly 420 will be a compressive engagement instead of a tensile engagement.)

Thus, the upper and bottom tool positioning assemblies may be employed to articulate tools into engagement with a workpiece, as well as to articulate the tools laterally with respect to the workpiece while engaged as part of a double-sided incremental forming operation. In some embodiments, the forming operation may be assisted by the use of a current applied to the workpiece, which may reduce the required force to perform the forming operation. For example, an isolated high current pathway configured to pass through a workpiece may be introduced within the system 300, which can result in improved formability of the workpiece.

Figure 6:
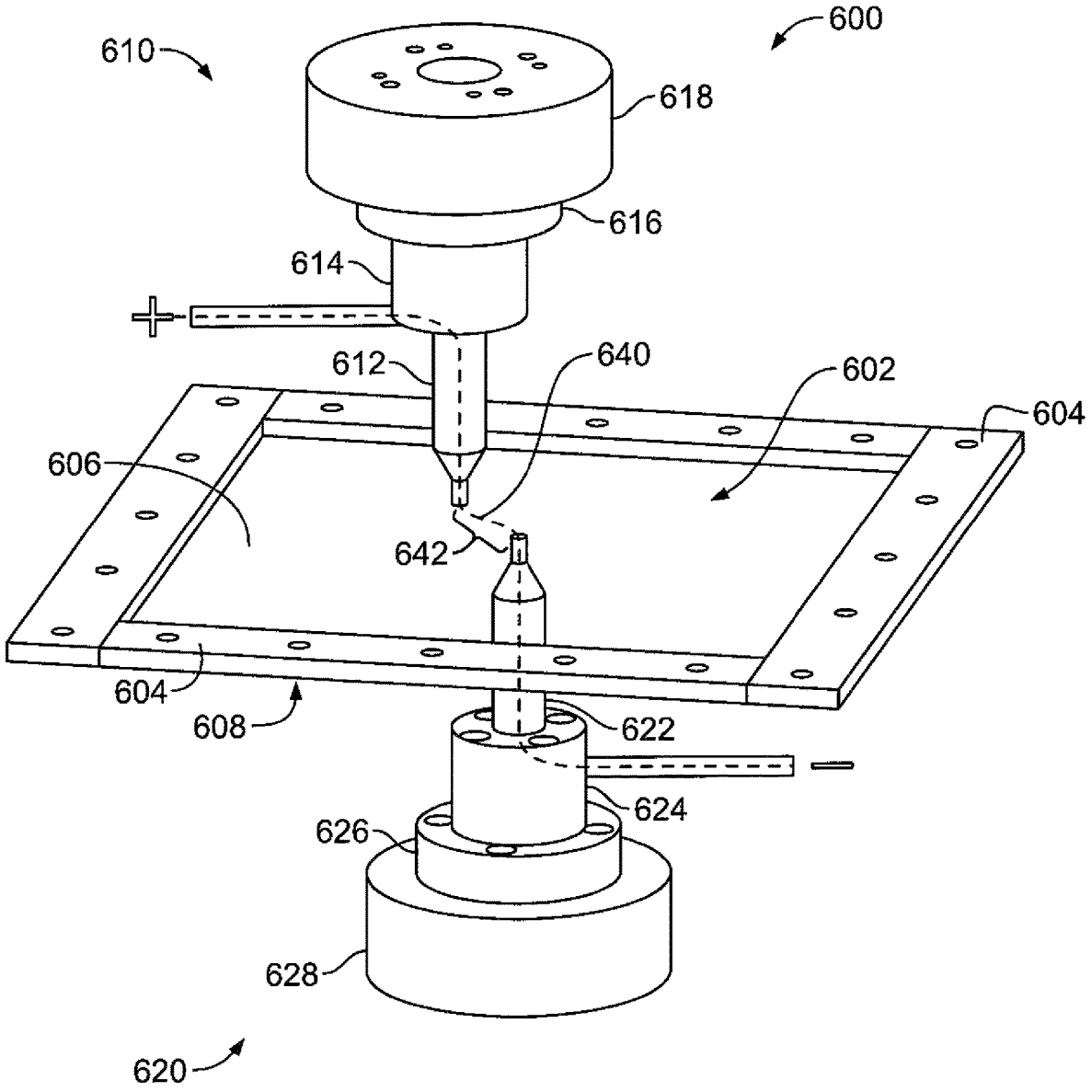
FIG. 6 is a schematic view of one embodiment of the incremental forming system shown in FIG. 2 using electrical forming assistance

FIG. 6 illustrates a system 600 for forming a workpiece in accordance with various embodiments. The system 600 includes a first tool assembly 610 and a second tool assembly 620 opposing each other and disposed on opposite sides of workpiece 602. In the illustrated embodiment, the workpiece 602 is a sheet of metal and is secured in place via sheet clamps 604. The sheet clamps 604 may be insulating sheet clamps to protect one or more frames (and anything such as an operator that may contact the frames) from a current passed through the workpiece 602. The workpiece 602 has an upper surface 606 oriented toward the first tool assembly 610 and a lower surface 608 oriented toward the second tool assembly 620.

The first tool assembly 610 includes a toolholder 614 configured to secure a tool 612 in place. The toolholder 614 is electrically coupled to a current source (e.g., current source 320, see discussion below). An insulating member 616 is interposed between the toolholder 614 and a load cell 618, to protect the load cell 618 and/or other components (e.g., one or more frames) to which the load cell 618 may be coupled directly or indirectly from the current from the current source. Similarly, the second tool assembly 620 includes a toolholder 624 configured to secure a tool 622 in place. The toolholder 624 is electrically coupled to a ground in the illustrated embodiment. An insulating member 626 is interposed between the toolholder 624 and a load cell 628, to protect the load cell 628 and/or other components (e.g., one or more frames) to which the load cell 628 may be coupled directly or indirectly from the current from the current source.

To perform a forming operation, the first tool assembly 610 may be articulated downward in the sense of FIG. 6 so that the tool 612 engages the upper surface 606 of the workpiece 602, and the second tool assembly 620 may be articulated upward in the sense of FIG. 6 so that the tool 612 engages the bottom surface 608 of the workpiece 602. With the toolholders 614, 624, tools 612, 622, and workpiece 602 made of electrically conductive materials, a circuit or current path 640 may be defined between the current source and the ground, passing from the current source through the toolholder 614, tool 612, workpiece 602, tool 622, and finally the toolholder 624 to the ground. A current path 642 in the workpiece 602 is shown between the tool 612 and the tool 622. Passage of a current through the workpiece 602 may be employed to reduce the forming forces required to form the workpiece 602, thereby allowing use of smaller, lighter, and/or less expensive components for a system (e.g., system 300) used for forming a workpiece. In alternate embodiments, for example embodiments configured for single-sided incremental forming, a current path may be established from a first tool through a workpiece to a ground associated with the workpiece.

Figure 7:
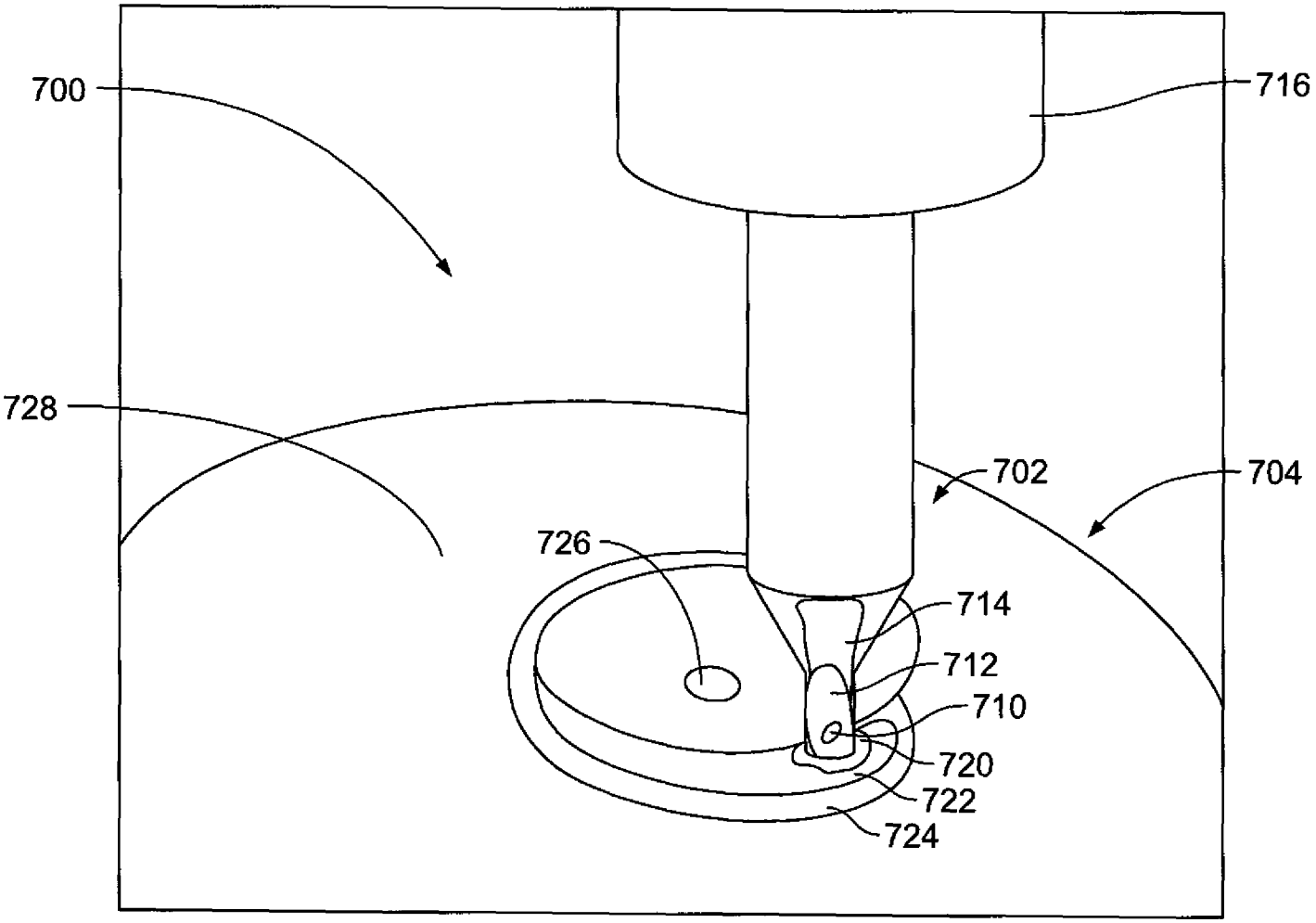
FIG. 7 depicts a thermal camera image of an incremental forming system in use in accordance with one example.

The passage of current and/or the bending or other forming of the workpiece may result in increased temperatures in the workpiece, tools, and/or toolholders. The temperature of these items may be monitored to improve current control, improve motion control of one or more tools engaging the workpiece, and/or help prevent overheating or other unsafe conditions. The temperature of the workpiece, tools, and/or toolholders may be monitored, for example, by a thermal imaging camera 308 that provides information corresponding to a temperature distribution. FIG. 7 illustrates a temperature distribution for a system 700 during a forming operation. The system includes a tool 702 being used to form a workpiece 704. In the illustrated embodiment, the workpiece 704 is a sheet of metal and the tool 702 includes a generally hemispherical head engaging the workpiece 702 during an incremental forming operation. For example, the forming operation may be performed with a current of 100 amps being passed through the workpiece 702 for a time period of about 7-8 minutes.

In the illustrated embodiment, the tool 704 and the workpiece 702 include several regions having various temperature ranges that form a temperature distribution. The temperatures may range, for example, from about 35 degrees Celsius to about 204 degrees Celsius. The tool 704 includes a first region 710, a second region 712, a third region 714, and a fourth region 716. The first region 710 includes the highest temperature range present in the tool 704, the second region 712 includes the second highest temperature range present in the tool 704, the third region 714 includes the second lowest temperature range present in the tool 704, and the fourth region 716 includes the lowest temperature range present in the tool 704.

The workpiece 702 includes a first region 720, a second region 722, a third region 724, a fourth region 726, and a fifth region 728. In the illustrated embodiment, the first region 720 includes the highest temperature range present in the workpiece 702, the second region 722 includes the second highest temperature range present in the workpiece 702, the third and fourth regions 724, 726 include the second lowest temperature range present in the workpiece 702, and the fifth region 728 includes the lowest temperature range present in the workpiece 702. Generally speaking, the closer a portion of the workpiece 702 is to the tool 704 during a forming operation, the higher the temperature.

If any of the temperature ranges exceed a threshold, then the current may be reduced or turned off, a forming force may be reduced, or a speed of articulation of one or more tools engaging the workpiece as part of an incremental forming process may be reduced. In some embodiments, a current, force, or speed may be adjusted, based on the distribution information obtained by the thermal imaging camera 308, to conform to or more closely match a previously determined preferred distribution associated with a given forming activity.

Returning to FIG. 2, the system 300 includes a control module 310 for controlling various activities of the system 300. As used herein, the terms "unit" or "module" include a hardware and/or software system that operates to perform one or more functions. For example, one or more units or modules may include or be embodied in one or more computer processors, controllers, and/or other logic-based devices that perform operations based on instructions stored on a tangible and non-transitory computer readable storage medium, such as a computer memory. Alternatively, a unit or module may include a hard-wired device that performs operations based on hard-wired logic of a processor, controller, or other device. In one or more embodiments, a unit or module includes or is associated with a tangible and non-transitory (e.g., not an electric signal) computer readable medium, such as a computer memory. The units or modules shown in the attached figures may represent the hardware that operates based on software or hardwired instructions, the computer readable medium used to store and/or provide the instructions, the software that directs hardware to perform the operations, or a combination thereof. The control module 310 shown in FIG. 2 may include or represent one or more input devices (e.g., keyboard, touchscreen, disk drive, microphone, and the like) to receive instructions from a human operator to direct how tools are moved to form components from the workpiece. In some embodiments, the control module 310 may receive a control plan or set of instructions for controlling the system 300 to perform a given forming operation. As the forming operation is performed, the control module may alter or modify the control plan or set of instructions based on information received from the load cell 1800 and/or the thermal imaging camera 308. The control module 310 may include one or more modules that perform the operations described herein. These modules are described below. In various embodiments, additional modules may be employed, different modules may be employed, modules may be further subdivided and/or combined, and/or the performance of various operations may be apportioned differently among various modules.

In the illustrated embodiment, the control module 310 includes a detection module 312, a motion module 314, and a memory 316 associated therewith. The detection module 312 is configured to receive or otherwise obtain information from one or more sensors or detectors. The motion module 314 is configured to control the positioning and movement of tools used for forming a workpiece. Further, the control module 310 may be operably connected to a current source 320 and configured to control an amount of current provided from the current source 320 to a workpiece via toolholders and tools of the system 300. In some embodiments, the amount of current may be controlled based on thermal information (such as, for example, a thermal distribution obtained via the thermal imaging camera 308). The current source 320 in some embodiments may be a battery or other power supply contained within the system 300, while in other embodiments the current source 320 may include a plug, wire, socket, or the like configured to receive a current from an external current supply.

The detection module 312 may receive information from, for example, the load cell 1800 and the thermal imaging camera 308. The information from the load cell 1800 may be used to determine a forming force. If the forming force is lower than a desired amount, then a corresponding tool or tools may be urged further into a workpiece (e.g., increasing an engagement distance) and/or urged with a larger amount of force. If the forming force is higher than a desired amount, the forming force or engagement distance may be reduced. Further, information from the load cell 1800 may indicate a fracture or other failure in the workpiece. The detection module 312, in some embodiments, is configured to receive thermal distribution information (e.g., from the thermal imaging camera), and determine if a temperature of a workpiece or tool exceeds a threshold, and/or determine if a temperature at a given location of the workpiece and/or a temperature distribution conforms to a desired temperature or distribution for a given forming activity.

The motion module 314 may receive input, for example, from an operator, or, as another example, from a stored pattern, and articulate the upper tool positioning assembly 302 and the lower tool positioning assembly 304 responsive to the input to form a desired shape or feature on a workpiece. Further, the motion module 314 may receive input from the detection module and adjust the articulation of the tool positioning assemblies 302, 304 accordingly. For example, if the detection module 312 determines that a fracture failure of the material has occurred (using, for example, information from the load cell 1800), the motion module 314 may cease forming operations and withdraw the tools from engagement with the workpiece. As another example, if the detection module determines that forces used in the forming process are too high (or too low), using, for example, information from the load cell 1800 and/or the thermal imaging camera 308, then the motion module 314 may decrease one or more engagement force used to urge a tool against a workpiece. For instance, if a threshold corresponding to a high risk of fracture is detected, the motion module 314 may control the tool positioning assemblies to reduce one or more forces being applied to the workpiece. As another example, the motion module 314 may adjust an engagement force, an amount of tool displacement, and/or a speed of tool displacement during a forming operation based on information received from the thermal imaging camera 308. Thus, the motion module 314 may adjust control of a forming operation using information (e.g., thermal information and/or force information) obtained during the forming operation.

Some embodiments may also include the capability to real-time heat treat a workpiece. The heat treatment may be controlled or varied temporally (e.g., varied over a given time period) or controlled or varied spatially (e.g., varied over a given area or volume). In the illustrated embodiment, the system 300 includes a heat treatment module 309 operably connected to the control module 310. In some embodiments, the heat treatment module 309 may include a laser. Alternatively or additionally, in some embodiments, the heat treatment module 309 may include a cooling pipe. For example, a laser may be used to locally heat all or a portion of a workpiece, and a cooling pipe (e.g., hose) may be used to cool the workpiece. In some embodiments, an air nozzle may be used to cool down the workpiece at a desired rate. In some embodiments, an optical fiber or other component of a laser and/or a cooling element (e.g., air nozzle) may be attached to one or more tools such that the movement of a heat treatment module and a tool are synchronized.

A bridge section 1200 may be included in the axis assembly 400 (as shown in FIGS. 3 and 4). A left side carriage mount 1300 may be mounted to the bridge section 1200, and a right side carriage mount 1400 may also be mounted to the bridge section 1200. The left side carriage mount 1300, right side carriage mount 1400, and bridge section 1200 in the illustrated embodiment are assembled to form a carriage structure 1201 that articulates along the guides of the x-axis assembly 420 and supports the guides of the y-axis assembly 460. The right side carriage mount 1400 provides an example of a first carriage 426 and the left side carriage mount 1400 provides an example of a second carriage 427 of the x-axis assembly 420. For example, in the illustrated embodiment, the left side carriage mount 1300 may include mounting holes configured for mounting of the left side carriage mount 1300 to the second drive assembly 425 (e.g., a carriage mount disposed on a linear drive actuated by a motor) and the right side carriage mount 1400 may include mounting holes configured for mounting of the right side carriage mount 1400 to the first drive assembly 424 of the x-axis assembly 420. A bridge support structure 1500 may be included in the axis assembly 400 (as shown in FIGS. 3-4). The bridge support structure 1500 may include an upper surface (to which the top brace 1600 is mounted) and a lower surface (to which the bottom brace 1700 is mounted). In some embodiments, the bridge support structure 1500 includes a first arm 1501 (which provides an example of a first carriage 446 of the y-axis assembly 440), and a second arm 1503 (which provides an example of a second carriage 447). The first arm 1501 may include mounting holes configured for mounting the first arm 1501 to the first drive assembly 444 of the y-axis assembly 440, and the second arm 1503 may include mounting holes configured for mounting the second arm 1503 to the second drive assembly 445 of the y-axis assembly 440. The bridge support structure 1500 may also include mounting holes configured for mounting the top and bottom braces 1600, 1700 to the bridge support structure 1500.

A top brace 1600 and a bottom brace 1500 may be included in the axis assembly 400 (as shown in FIGS. 3-4). The top brace 1600 and the bottom brace 1700 are configured to mount to the bridge support structure 1500 to form a carriage structure 1520 that articulates along the guides of the y-axis assembly 440 and supports the guides of the z-axis assembly 460. In some embodiments, the top brace 1600 and bottom brace 1700 may include mounting holes that correspond to mounting holes of the bridge support structure 1500 for mounting the top and bottom brace 1600, 1700 to the bridge support structure 1500. In alternate embodiments, the top and bottom braces may be formed integrally with the bridge support structure or otherwise joined to the bridge support structure.

As discussed above, a load cell 1800 that may be included in the axis assembly 400 (as shown in FIGS. 3-4). The load cell 1800, for example, may be a substantially disk shaped member configured to be mounted to the toolholder frame 2500, and including an opening (e.g., sized and configured for tool clearance). The load cell 1800 may also include mounting holes that are configured to accept fasteners for mounting the insulator member 1900 to the load cell 1800.

An insulator member 1900 may be included in the axis assembly 400 (as shown in FIGS. 3-4). The insulator member 1900 may include mounting holes that are configured to accept fasteners for mounting the insulator member 1900 to the load cell 1800, as well as mounting holes that are configured to accept fasteners for mounting the toolholder device 2000 to the insulator member 1900. In the illustrated embodiments, the insulator member 1900 is configured to be interposed between the toolholder device 2000 and the load cell 1800 and made of a material selected to insulate the load cell 1800 from a current passing through the toolholder device 2000.

The axis assembly 400 may include a toolholder device 2000 (see FIGS. 3-4). The toolholder device 2000 may be configured to hold a tool (e.g., tool 402). The toolholder device 2000 may include an opening configured to accept the tool, and openings configured for securing the tool. For example, the toolholder device 2000 may include threaded openings configured to accept set screws for securing a tool in an opening of the toolholder device 2000. The toolholder device 2000 may also include mounting holes configured to accept fasteners for mounting the toolholder device 2000 to the insulator member 1900.

The blankholder frame 2100 (see FIG. 2) may include an opening configured to accept a workpiece, such as a blank sheet of metal. The blankholder frame 2100 may also include clamp mounting holes configured for mounting clamps used to secure the workpiece in place. The blankholder frame 2100 is configured to be mounted to the frame 306.

Figure 10A:
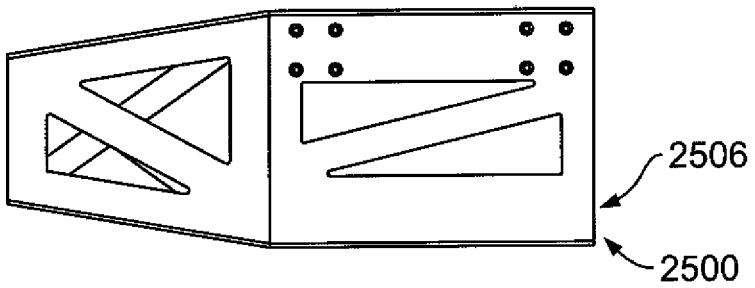
Figure 10B:
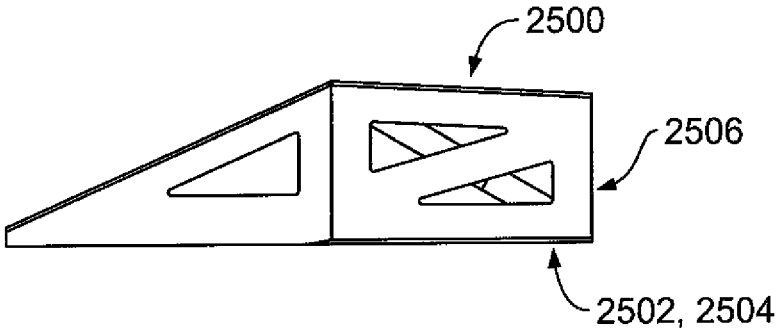
Figure 10C:
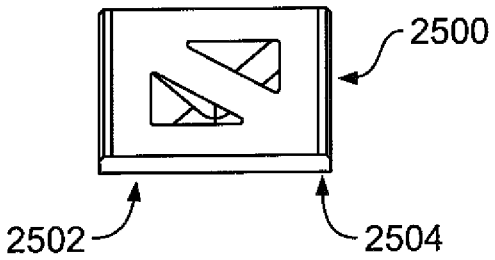

FIGS. 10A, 10B and 100 illustrate a toolholder frame 2500 that may be included in the axis assembly 400 (as shown in FIGS. 3-4). The toolholder frame is configured to secure the toolholder device 2000 in place. For example, the load cell 1800 may be mounted to a mounting surface 2506 of the toolholder frame 2500. The toolholder frame includes support members 2502 and 2504 configured to cooperate with the guides of the z-axis assembly 460. The toolholder frame 2500 (and support members 2502 and 2504) provide an example of first and second carriages for the z-axis assembly 460. Thus by articulating the toolholder frame 2500 along the guides of the z-axis assembly 460, a tool secured by the toolholder device 2000 may be brought into and out of engagement with a workpiece.

In some embodiments, the frame 306 and other components of the system 300 (e.g., toolholder frame 2500, carriage supports, bridge structures, and the like) may be fabricated or otherwise made using low cost materials. Various structural members may be assembled to construct a highly rigid frame (e.g., frame 306), which is easily assembled, and able to be modified at minimal cost.

In some embodiments, the system 300 includes modular, lightweight components of the frame 306. These components include, for example, the toolholder frame 2500, which may be made from low cost plate and tube steel, and modular X-Y and Z axis aluminum frame components.

In accordance with various embodiments, systems for and methods of tool movement and motion control utilize gantry-style axis assemblies (e.g., axis assembly 400) for each tool, allowing for consistent positional accuracy and force application throughout the 3-axis system range of motion (e.g., x, y, and z axes). Motors or other actuators may be included or coupled to the axis assemblies 400 to cause forming tools 402 (see FIG. 3) to move along the three (or other) axes to engage a workpiece, such as sheet metal, and to form shapes or features in the sheet of material. The components that make up the axis and their support may be designed and configured to ensure stiffness under maximum or increased operating loads, while minimizing or reducing deflection. Thus, even under instances of maximum or increased forming loads, the forming tools will not be "pushed away," and will remain at a desired position for forming. Additionally, the structural components may be designed to minimize or reduce weight, thus requiring a minimal or reduced amount of material to be used for fabrication.

Components may also be designed to minimize or reduce costs. As discussed above, a frame 306 including low cost steel beam extrusions may be used to house the individual axis assemblies (e.g., the top and bottom tool positioning assemblies 302, 304), as well as the blankholder frame (e.g., blankholder frame 2100). In some embodiments, only basic welding may be required to assemble the various sections of the frame 306. Other relatively lower cost methods, such as casting, may be used for components of a double-sided incremental forming system formed in accordance with various embodiments. Thus, use of CNC machining and precision assembly techniques may be reduced, further lowering costs and material used in fabrication.

In one embodiment, the system 300 uses relatively high electrical current assisted forming.

Double-sided incremental forming (DSIF) systems and methods may find a wide variety of uses or applications. DSIF may be understood, for example, as a complete product consisting of a DSIF machine and/or toolpath design software, or, as a service involving fabrication of parts using such a machine and/or software.

Various related issues, such as commercial issues, that may be addressed by or considered in connection with embodiments formed in accordance with the present disclosure may include reliability and repeatability targets, desired machine life vs. machine cost, machine size and weight, and software packaging. Additional attention may be given to supplemental manufacturing technologies required, supply chain requirements, lead time estimation, throughput capabilities and process planning. The analysis of these factors may be further divided into requirements specific to particular industrial or domestic sectors.

For example, in the aerospace industry, manufacturing is often characterized by low batch volumes. When conventional product specific tooling is used, a significant amount of investment goes into fabricating massive tooling and storing these tools for future repair or part replacement. If annual production volume is less than 5000 pieces and about 200 stamping dies are required every year, about 60% of these dies may be eliminated by using DSIF (e.g., DSIF performed using systems or methods disclosed herein) instead of conventional forming.

As another example, in the automotive industry, inexpensive rapid prototyping without repetitive fabrication of new tooling may be used to allow greater number of design iterations cheaply. It is estimated that the United States automotive industry uses about 300 low volume production dies and 2200 prototyping dies annually. It is estimated that about 80% of the prototyping dies and 60% of the low volume production dies may be replaced by DSIF. As each stamping die may cost about $1,000,000 on average, replacing conventional stamping in the aerospace and automotive industries alone may save up to about $2,060,000,000 annually.

As yet further examples, the defense sector has use for forming technologies that enable low recurring costs in low volume batch production and which have the portability and expendability to enable rapid, inexpensive on-site replacement and repairs of just a single component. In the biomedical industry, in-situ fabrication of sheet metal implants may reduce implant surgery time. The small machine size and high level of product customization achievable by DSIF allow these needs to be fulfilled.

In the domestic sector, use of DSIF systems and methods disclosed herein will enable improved, less expensive test marketing of new sheet metal products. Moreover, flexible forming technologies like DSIF may find further uses in emerging decentralized manufacturing paradigms, such as crowd sourcing and remote manufacturing.

Figure 11:
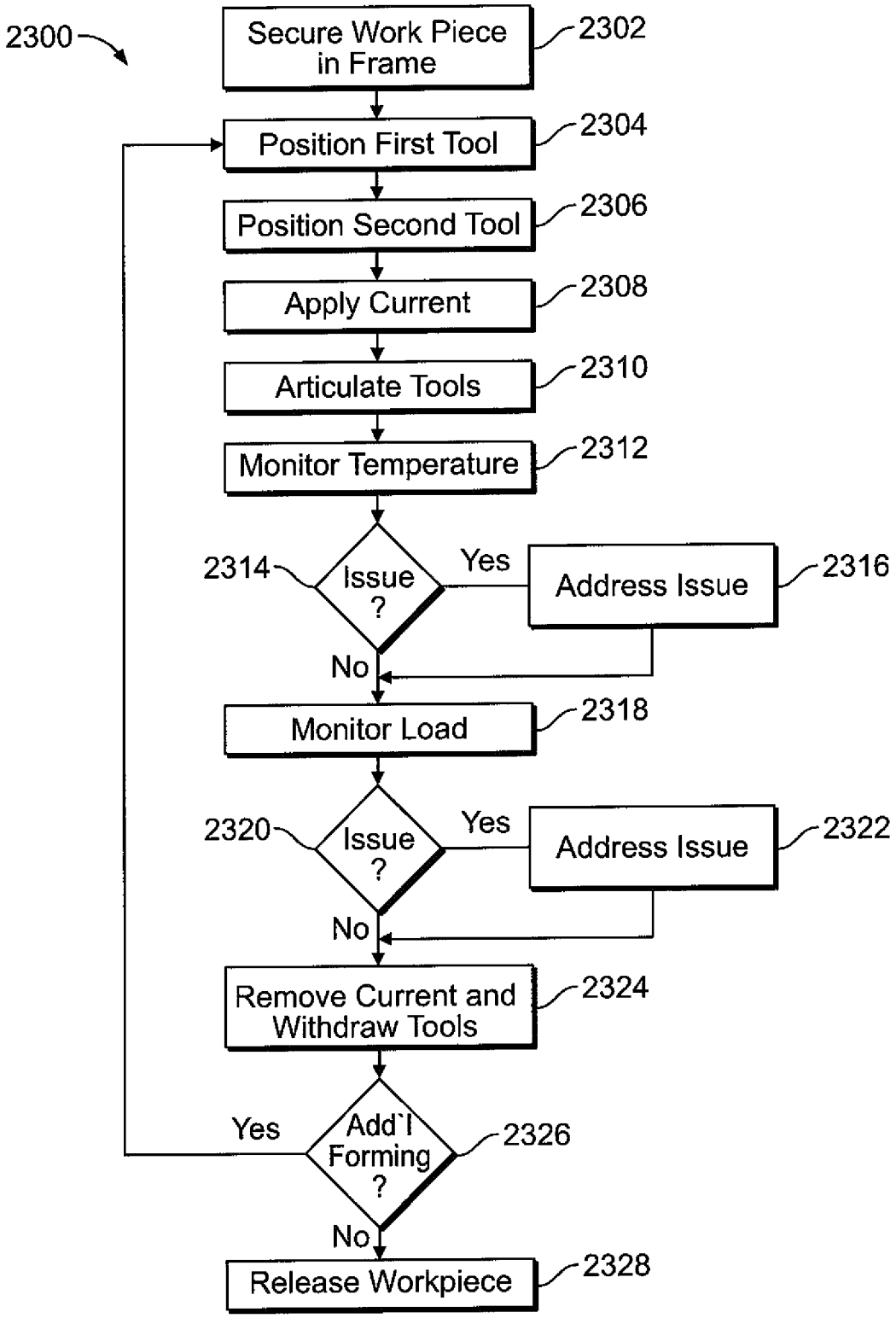
FIG. 11 is a flowchart of a method for forming a workpiece in accordance with an embodiment.

Systems and methods formed in accordance with various embodiments may address one or more of the applications discussed above. FIG. 11 provides a flowchart of an example method 2300 for double-sided incremental forming in accordance with various embodiments. The method 2300 may be used in conjunction with one or more embodiments of the system 300 described above. In various embodiments, certain steps may be omitted or added, certain steps may be combined, certain steps may be performed simultaneously, certain steps may be performed concurrently, certain steps may be split into multiple steps, certain steps may be performed in a different order, or certain steps or series of steps may be re-performed in an iterative fashion.

At 2302, a workpiece upon which one or more forming operations are to be performed is secured in place in a frame. In some embodiments, the workpiece is a sheet of metal. The workpiece may be secured to a blankholder frame (e.g., blankholder frame 2100) via clamps, with the blankholder frame mounted to a frame (e.g., frame 306) and interposed between axis assemblies (e.g., top and bottom tool positioning assemblies 302, 304), with each axis assembly having at least one tool secured thereto.

At 2304, a first tool is positioned. For example, the first tool may be urged toward a first surface (e.g., an upper surface) of the workpiece. The first tool may be positioned by articulation of an axis assembly (e.g., top tool positioning assembly 302) urging the tool along an axis into engagement with the workpiece at a desired location. The first tool may be engaged with the workpiece by being urged into the workpiece at a desired force level and/or a desired engagement distance (e.g., a distance extending past the point of first contact between the tool and the workpiece).

At 2306, a second tool is positioned. For example, a second tool may be urged toward a second surface (e.g., a lower surface) of the workpiece. The second tool may be positioned by articulation of an axis assembly (e.g., bottom tool positioning assembly 304) urging the tool along an axis into engagement with the workpiece at a selected location. The selected location may be proximate to the point of contact between the first tool positioned at 2304, for example displaced a relatively small amount in one or more lateral directions along the workpiece. The second tool may be engaged with the workpiece by being urged into the workpiece at a desired force level and/or a desired engagement distance (e.g., a distance extending past the point of first contact between the tool and the workpiece).

At 2308, a current is applied to the workpiece. For example, a current may be provided from a source to a first toolholder, from the first tool through the workpiece to the second tool, and then to a ground via a second toolholder. The current may be controlled by a control module. In some embodiments, the control module may control the current based on a measured characteristic of the workpiece. For example, a thermal imaging camera may provide thermal information of the workpiece used to determine appropriate adjustments to an amount of current, and the control module may adjust the current accordingly. The current is configured or controlled to allow forming of the workpiece with reduced force levels. For example, the introduction of the current may reduce the elastic recovery of a shape or feature formed in the workpiece. Various insulated components (e.g., insulating members disposed between the toolholders and corresponding load cells, insulating workpiece clamps) may be provided to eliminate or reduce the threat of danger or damage from uncontrolled current.

At 2310, with the first and second tools engaging opposite sides of the workpiece and a current passing therebetween, one or more of the first and second tools may be articulated in one or more lateral directions to form a shape or feature in the workpiece as part of a double-sided incremental forming process. The path of articulation may be provided by a pre-determined plan or pattern input into a control module. Further, the pre-determined plan or pattern may be adjusted based on one or more measured characteristics (e.g., a temperature detected by a thermal imaging camera 308, a force detected by a load cell 1800) determined during the forming operation.

For example, at 2312, the temperature of the workpiece and/or one or more of the tools is monitored. The temperature may be monitored by obtaining thermal distribution information during the forming operation via a thermal imaging camera 308. The temperature may be analyzed to help ensure a threshold temperature that may damage a tool or the workpiece is not exceeded, and/or to optimize the forming process, with the current, control of a tool path, or control of a force exerted on the workpiece adjusted responsive to the temperature information.

At 2314, it is determined if there is an issue raised by a detected temperature or temperature distribution based on the monitoring performed at 2312. If there is an issue, the issue is addressed at 2316. For example, if a temperature or temperature distribution deviates from a desired temperature or temperature distribution for a given forming operation, the current and/or articulation and/or force applied to the tools may be adjusted based on the determined temperature or temperature distribution. As another example, if a temperature exceeds a threshold, the forming operation may be terminated, or may be controlled to reduce the temperature (e.g., by reducing a current and/or force applied to the workpiece). If the issue raised by the detected temperature information is satisfactorily addressed, the method 2300 may proceed.

At 2318, a load or loads experienced during the forming process are monitored. During the forming process, forces exerted on the workpiece via the tools results in a loading of the particular axis assembly securing a given tool. This loading may be measured and/or monitored by a load cell, such as load cell 1800. Loading information may be provided by the load cell to a control module for analysis to help ensure that a threshold loading that may damage a tool, the workpiece, and/or a support structure such as an axis assembly or a frame, is not exceeded. Additionally or alternatively, the load may be monitored to optimize the forming process, with the control of a tool path or force adjusted responsive to the loading information.

At 2320, it is determined if there is an issue raised by a detected load based on the monitoring performed at 2318. If there is an issue, the issue is addressed at 2322. For example, if a sudden change in load is detected that indicates a fracture or impending fracture of the workpiece and/or damage to a support structure, the forming process may be halted, and the tools withdrawn from the workpiece. In some embodiments, an alarm (e.g., an audible alarm, a visible lighting alarm, a prompt provided on a screen, or the like) may be provided to alert an operator of the issue. As another example, if the load varies sufficiently from a desired loading for a particular forming operation, a control module may vary a force exerted on the workpiece. If the issue raised by the detected load information is satisfactorily addressed, the method 2300 may proceed until the desired shape or feature is completed.

At 2324, the current is removed from the workpiece, and the tools are drawn away from the workpiece. If, at 2326, it is determined that an additional feature or shape is to be formed, the method may return to 2304 with the tools positioned and articulated to form the additional shape or feature. If, at 2326, it is determined that no additional features or shapes are to be formed (e.g., the forming operation is complete), the workpiece may be removed from the frame at 2328.

Thus, embodiments disclose systems and methods that provide for a forming technique that is cheaper, smaller, more mobile and/or more user friendly than conventional forming technologies. Various embodiments provide for reduced costs for forming operations (e.g., low production forming), improved forming at reduced forming forces, improved control of forming operations, reduced reliance upon application specific tooling, increase utility of non-specific tooling across a variety of forming applications, improved mobility of forming equipment, and/or improved user friendliness of forming equipment or processes.

In one embodiment, a system includes a frame configured to hold a workpiece and first and second tool positioning assemblies coupled with the frame. The first and second tool positioning assemblies are configured to be opposed to each other on opposite sides of the frame. Each of the first and second tool positioning assemblies includes a toolholder, a first axis assembly, a second axis assembly, and a third axis assembly. The toolholder is configured to secure a tool to the tool positioning assembly. The first axis assembly is configured to articulate the toolholder along a first axis. The first axis assembly includes first and second guides extending generally parallel to the first axis and disposed on opposing sides of the toolholder with respect to the first axis. The first axis assembly includes first and second carriages articulable along the first and second guides of the first axis assembly, respectively, in the direction of the first axis. The second axis assembly is configured to articulate the toolholder along a second axis that is substantially perpendicular to the first axis. The second axis assembly includes first and second guides extending generally parallel to the second axis and disposed on opposing sides of the toolholder with respect to the second axis. The second axis assembly includes first and second carriages articulable along the first and second guides of the second axis assembly, respectively, in the direction of the second axis. The third axis assembly is configured to articulate the toolholder along a third axis that is substantially perpendicular to the first axis and substantially perpendicular to the second axis. The third axis assembly includes first and second guides extending generally parallel to the third axis and disposed on opposing sides of the toolholder with respect to the third axis. The third axis assembly includes first and second carriages articulable along the first and second guides of the third axis assembly, respectively, in the direction of the third axis.

In another aspect, the tool may include at least one of a substantially hemispheric surface, a conical surface, or a freeform surface configured to engage the workpiece.

In another aspect, the system may include a current source configured to deliver a current passing between the toolholder of the first tool positioning assembly and the toolholder of the second tool positioning assembly, wherein the current passes through the workpiece when a first tool secured to the first toolholder and a second tool secured to the second toolholder engage the workpiece.

In another aspect, each of the first and second tool positioning assemblies may include a toolholder frame movably coupled to the first and second guides of one of the first axis assembly, second axis assembly, or third axis assembly. The toolholder frame is configured to translate substantially along the first and second guides. The first and second tool positioning assemblies may also include an insulating member interposed between the toolholder frame and the toolholder. The insulating member is configured to insulate the toolholder frame from the current passing between the toolholder of the first tool positioning assembly and the toolholder of the second tool positioning assembly. In some embodiments, the insulating member may comprise a ceramic material.

In another aspect, the system may include a temperature detection unit configured to detect a temperature distribution corresponding to at least one of the tool and the workpiece as the current passes between the toolholder of the first tool positioning assembly and the toolholder of the second tool positioning assembly. The temperature detection unit may include a thermal imaging camera. Further, the system may include a control module configured to receive temperature information from the temperature detection unit and to control the articulation of one or more of the first tool or the second tool responsive to the temperature information.

In another aspect, the first and second carriages of the first axis assembly may be configured to be coupled to and to support the second axis assembly, the first and second carriages of the second axis assembly may be configured to be coupled to and to support the third axis assembly, and the toolholder may be operably connected to the third axis assembly whereby the toolholder articulates with the third axis assembly.

In another aspect, the system may include first, second, and third drive assemblies. The first drive assembly is operably coupled to at least one of the first and second guides of the first axis assembly, and configured to articulate the first and second carriages of the first axis assembly along the first and second guides of the first axis assembly. The second drive assembly is operably coupled to at least one of the first and second guides of the second axis assembly, and configured to articulate the first and second carriages of the second axis assembly along the first and second guides of the second axis assembly. The third drive assembly is operably coupled to at least one of the first and second guides of the third axis assembly, and configured to articulate the first and second carriages of the third axis assembly along the first and second guides of the third axis assembly.

In another aspect, the system may include a heat treatment module configured to heat treat the workpiece during a forming operation.

In another embodiment, a system is provided including a frame configured to hold a workpiece, first and second tool positioning assemblies coupled with the frame, and a current source configured to deliver a current. The first and second tool positioning assemblies are configured to be opposed to each other on opposite sides of the workpiece. The first tool positioning assembly includes a first toolholder configured to secure a first tool, and the second tool positioning assembly includes a second toolholder configured to secure a second tool. The first and second toolholders are configured to receive the current from the current source and to pass the current between the first and second toolholders and through the workpiece when the first tool and the second tool engage the workpiece.

In another aspect, each of the first and second tool positioning assemblies may include a toolholder frame movably coupled to a support structure of the tool positioning assembly, and an insulating member interposed between the toolholder frame and the one of the first and second toolholders associated with the tool positioning assembly. The insulating member is configured to insulate the toolholder frame from the current passing between the first toolholder and the second toolholder. Further, the insulating member may be made of a ceramic material.

In another aspect, the system may include at least a temperature detection unit or a displacement detection unit. The temperature detection unit may be configured to detect a temperature distribution corresponding to at least one of the tool and the workpiece as the current passes between the first toolholder and the second toolholder. Additionally, the temperature detection unit may include a thermal imaging camera. The system, in another aspect, may further include a control module configured to receive temperature information from the temperature detection unit and to control the articulation of one or more of the first tool or the second tool responsive to the temperature information.

In yet another embodiment, a method for forming a workpiece is provided. The method includes securing the workpiece in a frame. The method also includes drawing opposing first and second tools toward each other, with the first tool engaging a first side of the workpiece, and the second tool engaging a second, opposite side of the workpiece. The method further includes passing a current between the first and second tools, wherein the current passes through the workpiece. Also, the method includes articulating at least one of the first and second tools while the first and second tools engage the workpiece and the current passes through the workpiece.

In another aspect, the method may further include determining a temperature distribution of one or more of the workpiece or one or more of the first and second tools. In another aspect, determining a temperature distribution may include observing the one or more of the workpiece or one or more of the first and second tools with a thermal imaging camera.

In another aspect, the method may include controlling the articulating of the at least one of the first and second tools responsive to the temperature distribution.

In another aspect, the articulating the at least one of the first and second tools may include articulating a toolholder securing the at least one of the first and second tools. The toolholder in some embodiments is secured to an assembly including a first gantry-style axis assembly configured to articulate the toolholder along a first axis, a second gantry-style axis assembly configured to articulate the toolholder along a second axis that is substantially perpendicular to the first axis, and a third gantry-style axis assembly configured to articulate the toolholder along a third axis that is substantially perpendicular to the first axis and substantially perpendicular to the second axis.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are example embodiments. Many other embodiments will be apparent to one of ordinary skill in the art upon reviewing the above description. The scope of the inventive subject matter should, therefore, be determined with reference to the appended clauses, along with the full scope of equivalents to which such clauses are entitled. In the appended clauses, the terms "including" and "in which" are used as the plain-English equivalents of the respective terms "comprising" and "wherein." Moreover, in the following clauses, the terms "first," "second," and "third," etc., are used merely as labels, and are not intended to impose numerical requirements on their objects. Further, the limitations of the following clauses are not written in means-plus-function format and are not intended to be interpreted based on 35 U.S.C. § 112, sixth paragraph, unless and until such clause limitations expressly use the phrase "means for" followed by a statement of function void of further structure.

This written description uses examples to disclose several embodiments of the inventive subject matter, including the best mode, and also to enable one of ordinary skill in the art to practice the embodiments of inventive subject matter, including making and using any devices or systems and performing any incorporated methods. The patentable scope of the inventive subject matter is defined by the clauses, and may include other examples that occur to one of ordinary skill in the art. Such other examples are intended to be within the scope of the clauses if they have structural elements that do not differ from the literal language of the clauses, or if they include equivalent structural elements with insubstantial differences from the literal languages of the clauses.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the presently described subject matter are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property.

The invention claimed is:

1. A method for forming a sheet metal work piece comprising:

providing a system comprising:

a frame;

a blankholder configured to hold the work piece, wherein the blankholder is secured directly to the frame;

first and second tool positioning assemblies coupled with the frame, the first and second tool positioning assemblies configured to be opposed to each other on opposite sides of the work piece;

the first tool positioning assembly including a first tool holder configured to secure a first tool;

the second tool positioning assembly including a second tool holder configured to secure a second tool;

each of the first and second tool positioning assemblies comprising a tool holder frame movably coupled to a support structure of the tool positioning assembly and an insulating member interposed between the tool holder frame and one of the first and second tool holders associated with the tool positioning assembly, the insulating member configured to insulate the tool holder frame from a current passing between the first tool holder and the second tool holder; and a current source configured to deliver the current, wherein the first and second tool holders are configured to receive the current from the current source and to pass the current between the first and second tool holders and through the work piece when the first tool and the second tool engage the work piece;

securing the work piece in the frame and insulating the work piece from the frame;

drawing the opposing first and second tools toward each other wherein the first tool engages a first side of the work piece and the second tool engages a second, opposite side of the work piece;

passing the current between the first and second tools, wherein the current passes through the work piece; and articulating at least one of the first and second tools while the first and second tools engage the work piece and the current passes through the work piece; and wherein a heating of the work piece is regulated by a forming force of the first tool and the second tool engaging the work piece.

2. The method of claim 1, further comprising determining a temperature distribution of one or more of the work piece and the first and second tools.

3. The method of claim 2, wherein the determining a temperature distribution comprises observing the one or more of the work piece and the first and second tools with a thermal imaging camera.

4. The method of claim 2, further comprising controlling the articulating of the at least one of the first and second tools responsive to the temperature distribution.

5. The method of claim 1, wherein the articulating the at least one of the first and second tools comprises respectively articulating the tool holder securing the at least one of the first and second tools, the tool holder secured to the assembly including a first gantry-style axis assembly configured to articulate the tool holder along a first axis, a second gantry-style axis assembly configured to articulate the tool holder along a second axis that is substantially perpendicular to the first axis, and a third gantry style axis assembly configured to articulate the tool holder along a third axis that is substantially perpendicular to the first axis and substantially perpendicular to the second axis.

6. The method of claim 1, further comprising determining a temperature distribution and an engagement force of one or more of the work piece and the first and second tools.

7. The method of claim 6, wherein the determining a temperature distribution comprises observing the one or more of the work piece and the first and second tools with a thermal imaging camera and the determining an engagement force comprises measuring the engagement force of one or more of the work piece and the first and second tools with a load cell.

8. The method of claim 6, further comprising controlling the articulating of the at least one of the first and second tools responsive to the temperature distribution and the engagement force.

9. A method for forming a sheet metal work piece comprising:

providing a system comprising:

a frame;

a blankholder configured to hold the work piece, wherein the blankholder is secured directly to the frame;

a thermal imaging camera;

first and second tool positioning assemblies coupled with the frame, the first and second tool positioning assemblies configured to be opposed to each other on opposite sides of the work piece;

the first tool positioning assembly including a first tool holder configured to secure a first tool;

the second tool positioning assembly including a second tool holder configured to secure a second tool;

each of the first and second tool positioning assemblies comprising a tool holder frame movably coupled to a support structure of the tool positioning assembly and an insulating member interposed between the tool holder frame and one of the first and second tool holders associated with the tool positioning assembly, the insulating member configured to insulate the tool holder frame from a current passing between the first tool holder and the second tool holder; and a current source configured to deliver the current, wherein the first and second tool holders are configured to receive the current from the current source and to pass the current between the first and second tool holders and through the work piece when the first tool and the second tool engage the work piece;

securing the work piece in the frame and insulating the work piece from the frame;

drawing the opposing first and second tools toward each other wherein the first tool engages a first side of the work piece and the second tool engages a second, opposite side of the work piece;

passing the current between the first and second tools, wherein the current passes through the work piece;

articulating at least one of the first and second tools while the first and second tools engage the work piece and the current passes through the work piece; and determining a temperature distribution and an engagement force of one or more of the work piece and the first and second tools;

wherein the determining a temperature distribution comprises observing the one or more of the work piece and the first and second tools with a thermal imaging camera;

wherein a heating of the work piece is regulated by a forming force of the first tool and the second tool engaging the work piece; and wherein a heating of the work piece is regulated by a speed of articulation of the first tool and the second tool engaging the work piece.

10. The method of claim 9, wherein the articulating the at least one of the first and second tools comprises respectively articulating the tool holder securing the at least one of the first and second tools, the tool holder secured to the assembly including a first gantry-style axis assembly configured to articulate the tool holder along a first axis, a second gantry-style axis assembly configured to articulate the tool holder along a second axis that is substantially perpendicular to the first axis, and a third gantry style axis assembly configured to articulate the tool holder along a third axis that is substantially perpendicular to the first axis and substantially perpendicular to the second axis.

11. A method for forming a sheet metal work piece comprising:

providing a system comprising:

a frame;

a blankholder configured to hold the work piece, wherein the blankholder is secured directly to the frame;

first and second tool positioning assemblies coupled with the frame, the first and second tool positioning assemblies configured to be opposed to each other on opposite sides of the work piece;

the first tool positioning assembly including a first tool holder configured to secure a first tool;

the second tool positioning assembly including a second tool holder configured to secure a second tool;

each of the first and second tool positioning assemblies comprising a tool holder frame movably coupled to a support structure of the tool positioning assembly and an insulating member interposed between the tool holder frame and one of the first and second tool holders associated with the tool positioning assembly, the insulating member configured to insulate the tool holder frame from a current passing between the first tool holder and the second tool holder; and a current source configured to deliver the current, wherein the first and second tool holders are configured to receive the current from the current source and to pass the current between the first and second tool holders and through the work piece when the first tool and the second tool engage the work piece;

securing the work piece in the frame and insulating the work piece from the frame;

drawing the opposing first and second tools toward each other wherein the first tool engages a first side of the work piece and the second tool engages a second, opposite side of the work piece;

passing the current between the first and second tools, wherein the current passes through the work piece; and articulating at least one of the first and second tools while the first and second tools engage the work piece and the current passes through the work piece; and wherein a heating of the work piece is regulated by a speed of articulation of the first tool and the second tool engaging the work piece.

12. The method of claim 11, further comprising determining a temperature distribution of one or more of the work piece and the first and second tools.

13. The method of claim 12, wherein the determining a temperature distribution comprises observing the one or more of the work piece and the first and second tools with a thermal imaging camera.

14. The method of claim 12, further comprising controlling the articulating of the at least one of the first and second tools responsive to the temperature distribution.

15. The method of claim 11, wherein the articulating the at least one of the first and second tools comprises respectively articulating the tool holder securing the at least one of the first and second tools, the tool holder secured to the assembly including a first gantry-style axis assembly configured to articulate the tool holder along a first axis, a second gantry-style axis assembly configured to articulate the tool holder along a second axis that is substantially perpendicular to the first axis, and a third gantry style axis assembly configured to articulate the tool holder along a third axis that is substantially perpendicular to the first axis and substantially perpendicular to the second axis.

16. The method of claim 11, further comprising determining a temperature distribution and an engagement force of one or more of the work piece and the first and second tools.

17. The method of claim 16, wherein the determining a temperature distribution comprises observing the one or more of the work piece and the first and second tools with a thermal imaging camera and the determining an engagement force comprises measuring the engagement force of one or more of the work piece and the first and second tools with a load cell.

18. The method of claim 16, further comprising controlling the articulating of the at least one of the first and second tools responsive to the temperature distribution and the engagement force.

* * * * *